US011598559B2

(12) United States Patent
Takegami et al.

(10) Patent No.: US 11,598,559 B2
(45) Date of Patent: Mar. 7, 2023

(54) HEAT SOURCE-SIDE UNIT AND REFRIGERATION APPARATUS

(71) Applicant: DAIKIN INDUSTRIES, LTD., Osaka (JP)

(72) Inventors: Masaaki Takegami, Osaka (JP); Shuichi Taguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/684,109

(22) Filed: Mar. 1, 2022

(65) Prior Publication Data

US 2022/0186987 A1 Jun. 16, 2022

Related U.S. Application Data

(63) Continuation of application No. PCT/JP2020/025231, filed on Jun. 26, 2020.

(30) Foreign Application Priority Data

Sep. 30, 2019 (JP) ..... JP2019-180391

(51) Int. Cl.
*F25B 1/10* (2006.01)
*F25B 9/00* (2006.01)

(52) U.S. Cl.
CPC ..... *F25B 1/10* (2013.01); *F25B 9/008* (2013.01); *F25B 2309/06* (2013.01); *F25B 2400/19* (2013.01); *F25B 2600/2501* (2013.01)

(58) Field of Classification Search
CPC ..... F25B 1/10; F25B 9/008; F25B 2309/06; F25B 2400/19; F25B 2600/2501
See application file for complete search history.

(56) References Cited

U.S. PATENT DOCUMENTS

2013/0213084 A1 8/2013 Takizawa et al.
2013/0298593 A1* 11/2013 Christensen ..... F25B 9/008 62/467

FOREIGN PATENT DOCUMENTS

EP 3 351 870 A1 7/2018
JP 2502719 B2 5/1996
(Continued)

OTHER PUBLICATIONS

International Search Report for PCT/JP2020/025231 (PCT/ISA/210) dated Aug. 11, 2020.
(Continued)

*Primary Examiner* — Miguel A Diaz
(74) *Attorney, Agent, or Firm* — Birch, Stewart, Kolasch & Birch, LLP

(57) ABSTRACT

A heat source-side unit (10) includes a heat source-side circuit (11). The heat source-side circuit (11) includes a compression unit (20) including a lower-stage compression element (23) and a higher-stage compression element (21), an intermediate heat exchanger (17) disposed on a refrigerant path between the lower-stage compression element (23) and the higher-stage compression element (21), and a bypass passage (23*c*) connected to a suction pipe (23*a*) and a discharge pipe (23*b*) each connected to the lower-stage compression element (23). At startup of the compression unit (20), a first action is performed for stopping the lower-stage compression element (23) and operating the higher-stage compression element (21). This configuration thus suppresses occurrence of liquid compression at startup of a compressor.

8 Claims, 12 Drawing Sheets

(56) References Cited

FOREIGN PATENT DOCUMENTS

| | | | | | |
|---|---|---|---|---|---|
| JP | 2001296068 | A | * | 10/2001 | |
| JP | 2008-164205 | A | | 7/2008 | |
| JP | 2010-210204 | A | | 9/2010 | |
| JP | 2012-36933 | A | | 2/2012 | |
| JP | 2019-66068 | A | | 4/2019 | |
| JP | 2019-66086 | A | | 4/2019 | |
| WO | WO-2011135805 | A1 | * | 11/2011 | ..... F25B 1/10 |
| WO | WO-2021065116 | A1 | * | 4/2021 | ..... F25B 1/10 |
| WO | WO-2022101139 | A2 | * | 5/2022 | |

OTHER PUBLICATIONS

Written Opinion of the International Searching Authority for PCT/JP2020/025231 (PCT/ISA/237) dated Aug. 11, 2020.

English translation of International Preliminary Report on Patentability and Written Opinion of the International Searching Authority for International Application No. PCT/JP/2020/025231, dated Apr. 14, 2022.

Extended European Search Report dated Sep. 12, 2022 in counterpart European Application No. 20873075.4.

* cited by examiner

COOLING AND COOLING-FACILITY OPERATION

HEATING AND COOLING-FACILITY OPERATION

HEATING AND COOLING-FACILITY HEAT RECOVERY OPERATION

HEATING AND COOLING-FACILITY WASTE HEAT OPERATION

FIG.12A (a)

Control on outdoor fan

・DOWN condition

HP＜7.2(MPa) & HP saturation temperature − outside temperature＜5(deg)

(High pressure excessively drops at subcritical pressure)

or

HP＞7.2(MPa) & gas cooler outlet temperature − outside temperature＜2(deg)

(Fan wastefully consumes power since fan excessively provides air at supercritical pressure)

・UP condition

HP＜7.2(MPa) & HP saturation temperature − outside temperature＞10(deg)

(High pressure rises at subcritical pressure)

or

HP＞7.2(MPa) & gas cooler outlet temperature − outside temperature＞4(deg)

(Fan insufficiently provides air at supercritical pressure)

FIG.12B (b)

Control on first compressor

・DOWN condition MP＜target evaporation pressure

・UP condition MP＞target evaporation pressure

FIG.12C (c)

Control on fan for intermediate heat exchanger

・DOWN condition Outside air＜Ts3 (Refrigerant does not evaporate at outside temperature)

・UP condition Degree of superheating of refrigerant sucked in higher-stage compression element SH＜5(deg)

HEAT SOURCE-SIDE UNIT AND REFRIGERATION APPARATUS

CROSS REFERENCE TO RELATED APPLICATIONS

This application is a Continuation of PCT International Application No. PCT/JP2020/025231, filed on Jun. 26, 2020, which claims priority under under 35 U.S.C. 119(a) to Patent Application No. 2019-180391, filed in Japan on Sep. 30, 2019, all of which are hereby expressly incorporated by reference into the present application.

TECHNICAL FIELD

The present disclosure relates to a heat source-side unit and a refrigeration apparatus.

BACKGROUND ART

As disclosed in, for example, Patent Literature 1, there is a refrigeration apparatus that includes a heat source-side unit including a receiver (a gas-liquid separator). The refrigeration apparatus disclosed in Patent Literature 1 is configured to reduce a pressure at the receiver in changing from a cooling operation to a reverse cycle defrosting operation in a utilization-side unit, thereby suppressing backflow of a refrigerant toward the utilization-side unit.

CITATION LIST

Patent Literature

Patent Literature 1: JP 2019-066086 A

SUMMARY

A first aspect of the present disclosure is based on a heat source-side unit to be connected to a utilization-side device to constitute a refrigerant circuit (6) in conjunction with the utilization-side device.

The heat source-side unit includes a heat source-side circuit (11) constituting at least a part of the refrigerant circuit (6), and a control unit (100) configured to control an action of the heat source-side circuit (11).

The heat source-side circuit (11) includes a compression unit (20) including a lower-stage compression element (23) configured to compress a refrigerant, and a higher-stage compression element (21) configured to further compress the refrigerant compressed by the lower-stage compression element (23), an intermediate heat exchanger (17) disposed on a refrigerant path between the lower-stage compression element (23) and the higher-stage compression element (21) and configured to cause the refrigerant to exchange heat with a heating medium, and a bypass passage (23*c*) connected to a suction pipe (23*a*) and a discharge pipe (23*b*) each connected to the lower-stage compression element (23), for bypassing the lower-stage compression element (23).

The control unit (100) performs a first action of stopping the lower-stage compression element (23) and operating the higher-stage compression element (21) at startup of the compression unit (20), and the control unit (100) performs the first action on condition that a suction pressure of the compression unit (20) has a value more than a predetermined value.

BRIEF DESCRIPTION OF THE DRAWINGS

FIG. 12A illustrates details of control (a) in step ST15 of FIG. 11.

FIG. 12B illustrates details of control (b) in step ST15 of FIG. 11.

FIG. 12C illustrates details of control (c) in step ST15 of FIG. 11.

DESCRIPTION OF EMBODIMENTS

Embodiments will be described below with reference to the drawings. The following embodiments are preferable examples in nature and are not intended to limit the scope of the present invention, products to which the present invention is applied, or the use of the present invention.

Embodiment

<General Configuration>

A refrigeration apparatus (1) according to an embodiment is configured to cool a cooling target and to condition indoor air. The term "cooling target" as used herein may involve air in a refrigeration facility such as a refrigerator, a freezer, or a showcase. In the following description, such a facility is referred to as a cooling facility.

Figure 1:
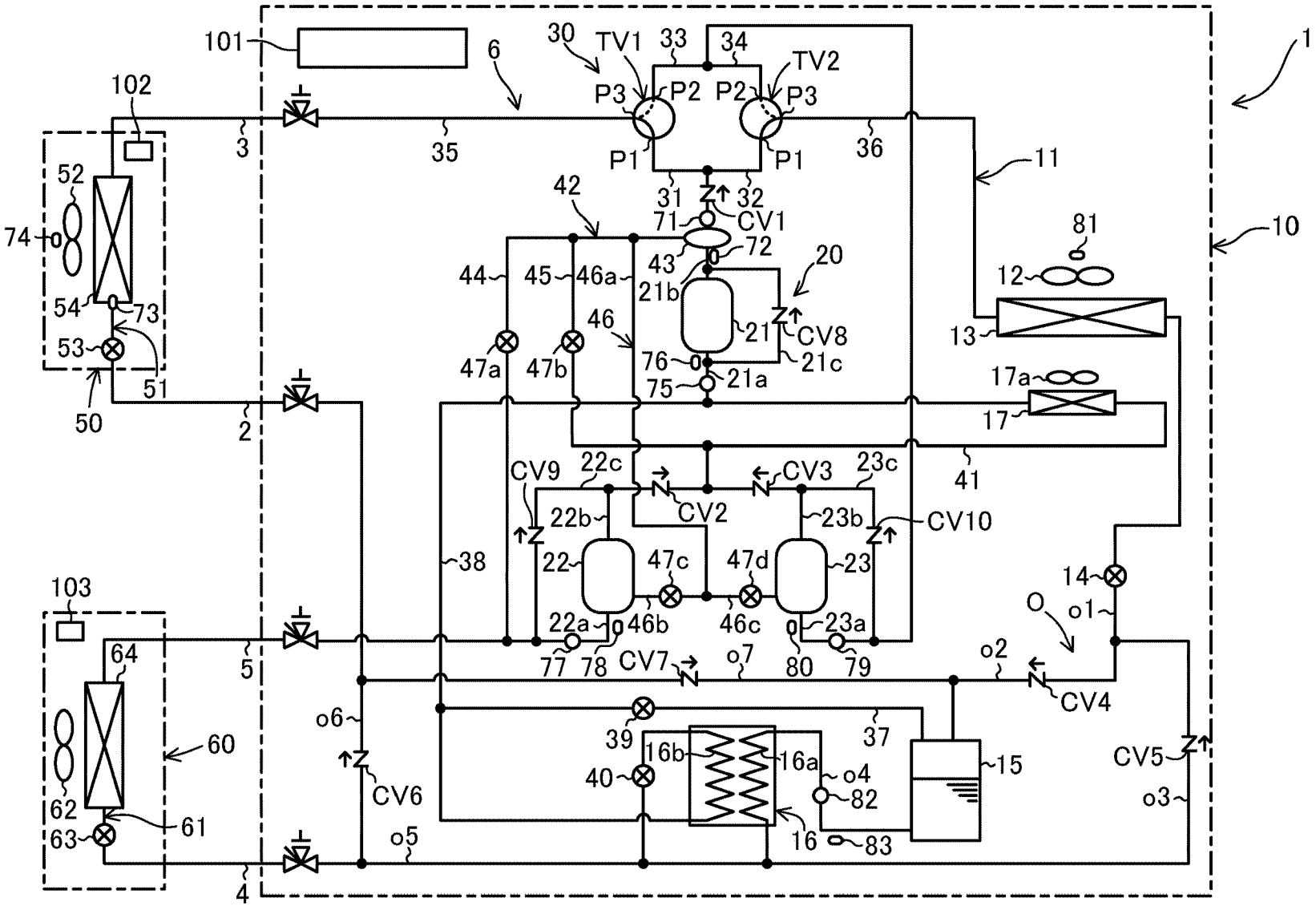
FIG. 1 is a diagram of a piping system in a refrigeration apparatus according to an embodiment.

As illustrated in FIG. 1, the refrigeration apparatus (1) includes an outdoor unit (10) installed outdoors, an indoor unit (50) configured to condition indoor air, a cooling facility unit (60) configured to cool inside air, and a controller (100). The refrigeration apparatus (1) illustrated in FIG. 1 includes one indoor unit (50). The refrigeration apparatus (1) may alternatively include a plurality of indoor units (50) connected in parallel. The refrigeration apparatus (1) illustrated in FIG. 1 includes one cooling facility unit (60). The refrigeration apparatus (1) may alternatively include a plurality of cooling facility units (60) connected in parallel. In this embodiment, these units (10, 50, 60) are connected via four connection pipes (2, 3, 4, 5) to constitute a refrigerant circuit (6) including a plurality of constituent elements.

The four connection pipes (2, 3, 4, 5) include a first liquid connection pipe (2), a first gas connection pipe (3), a second liquid connection pipe (4), and a second gas connection pipe (5). The first liquid connection pipe (2) and the first gas connection pipe (3) are provided for the indoor unit (50). The second liquid connection pipe (4) and the second gas connection pipe (5) are provided for the cooling facility unit (60).

A refrigeration cycle is achieved in such a manner that a refrigerant circulates through the refrigerant circuit (6). In this embodiment, the refrigerant in the refrigerant circuit (6) is carbon dioxide. The refrigerant circuit (6) is configured to perform a refrigeration cycle in which a pressure above a critical pressure is applied to the refrigerant.

<Outdoor Unit>

The outdoor unit (10) is a heat source-side unit to be installed outdoors. The outdoor unit (10) includes an outdoor fan (12) and an outdoor circuit (11) (which is an example of a heat source-side circuit). The outdoor circuit (11) includes a compression unit (20), a flow path switching mechanism (30), an outdoor heat exchanger (13), an outdoor expansion valve (14), a gas-liquid separator (15), a cooling heat exchanger (16), and an intermediate heat exchanger (17) that serve as the constituent elements of the refrigerant circuit (6). The outdoor circuit (11) constitutes at least a part of the refrigerant circuit (6).

<Compression Unit>

The compression unit (20) is configured to compress the refrigerant. The compression unit (20) includes a first compressor (21), a second compressor (22), and a third compressor (23). The compression unit (20) is of a two-stage compression type. The second compressor (22) and the third compressor (23) constitute a lower-stage compression element configured to compress the refrigerant. The second compressor (22) and the third compressor (23) are connected in parallel. The first compressor (21) constitutes a higher-stage compression element configured to further compress the refrigerant compressed by the lower-stage compression element. The first compressor (21) and the second compressor (22) are connected in series. The first compressor (21) and the third compressor (23) are connected in series. Each of the first compressor (21), the second compressor (22), and the third compressor (23) is a rotary compressor that includes a compression mechanism to be driven by a motor. Each of the first compressor (21), the second compressor (22), and the third compressor (23) is of a variable capacity type, and the operating frequency or the number of rotations of each compressor is adjustable.

A first suction pipe (21*a*) and a first discharge pipe (21*b*) are connected to the first compressor (21). A second suction pipe (22*a*) and a second discharge pipe (22*b*) are connected to the second compressor (22). A third suction pipe (23*a*) and a third discharge pipe (23*b*) are connected to the third compressor (23).

A first bypass passage (21*c*) is connected to the first suction pipe (21*a*) and the first discharge pipe (21*b*), for bypassing the first compressor (21). A second bypass passage (22*c*) is connected to the second suction pipe (22*a*) and the second discharge pipe (22*b*), for bypassing the second compressor (22). A third bypass passage (23*c*) is connected to the third suction pipe (23*a*) and the third discharge pipe (23*b*), for bypassing the third compressor (23).

The second suction pipe (22*a*) communicates with the cooling facility unit (60). The second compressor (22) is a cooling facility-side compressor provided for the cooling facility unit (60). The third suction pipe (23*a*) communicates with the indoor unit (50). The third compressor (23) is an indoor-side compressor provided for the indoor unit (50).

<Flow Path Switching Mechanism>

The flow path switching mechanism (30) is configured to switch a refrigerant flow path. The flow path switching mechanism (30) includes a first pipe (31), a second pipe (32), a third pipe (33), a fourth pipe (34), a first three-way valve (TV1), and a second three-way valve (TV2). The first pipe (31) has an inlet end connected to the first discharge pipe (21*b*). The second pipe (32) has an inlet end connected to the first discharge pipe (21*b*). Each of the first pipe (31) and the second pipe (32) is a pipe on which a discharge pressure of the compression unit (20) acts. The third pipe (33) has an outlet end connected to the third suction pipe (23*a*) of the third compressor (23). The fourth pipe (34) has an outlet end connected to the third suction pipe (23*a*) of the third compressor (23). Each of the third pipe (33) and the fourth pipe (34) is a pipe on which a suction pressure of the compression unit (20) acts.

The first three-way valve (TV1) has a first port (P1), a second port (P2), and a third port (P3). The first port (P1) of the first three-way valve (TV1) is connected to an outlet end of the first pipe (31) serving as a high-pressure flow path. The second port (P2) of the first three-way valve (TV1) is connected to an inlet end of the third pipe (33) serving as a low-pressure flow path. The third port (P3) of the first three-way valve (TV1) is connected to an indoor gas-side flow path (35).

The second three-way valve (TV2) has a first port (P1), a second port (P2), and a third port (P3). The first port (P1) of the second three-way valve (TV2) is connected to an outlet end of the second pipe (32) serving as a high-pressure flow path. The second port (P2) of the second three-way valve (TV2) is connected to an inlet end of the fourth pipe (34) serving as a low-pressure flow path. The third port (P3) of the second three-way valve (TV2) is connected to an outdoor gas-side flow path (36).

Each of the first three-way valve (TV1) and the second three-way valve (TV2) is an electrically driven three-way valve. Each three-way valve (TV1, TV2) is switched to a first state (a state indicated by a solid line in FIG. 1) and a second state (a state indicated by a broken line in FIG. 1). In each three-way valve (TV1, TV2) switched to the first state, the first port (P1) and the third port (P3) communicate with each other and the second port (P2) is closed. In each three-way valve (TV1, TV2) switched to the second state, the second port (P2) and the third port (P3) communicate with each other and the first port (P1) is closed.

<Outdoor Heat Exchanger>

The outdoor heat exchanger (13) serves as a heat source-side heat exchanger. The outdoor heat exchanger (13) is a fin-and-tube air heat exchanger. The outdoor fan (12) is disposed near the outdoor heat exchanger (13). The outdoor fan (12) is configured to provide outdoor air. The outdoor heat exchanger causes the refrigerant flowing therethrough to exchange heat with the outdoor air provided by the outdoor fan (12).

The outdoor heat exchanger (13) has a gas end to which the outdoor gas-side flow path (36) is connected. The outdoor heat exchanger (13) has a liquid end to which an outdoor flow path (0) is connected.

<Outdoor Flow Path>

The outdoor flow path (O) includes an outdoor first pipe (o1), an outdoor second pipe (o2), an outdoor third pipe (o3), an outdoor fourth pipe (o4), an outdoor fifth pipe (o5), an outdoor sixth pipe (o6), and an outdoor seventh pipe (o7).

The outdoor first pipe (o1) has a first end connected to the liquid end of the outdoor heat exchanger (13). The outdoor first pipe (o1) has a second end to which a first end of the outdoor second pipe (o2) and a first end of the outdoor third pipe (o3) are connected. The outdoor second pipe (o2) has a second end connected to a top portion of the gas-liquid separator (15). The outdoor fourth pipe (o4) has a first end connected to a bottom portion of the gas-liquid separator (15). The outdoor fourth pipe (o4) has a second end to which a first end of the outdoor fifth pipe (o5) and a second end of the outdoor third pipe (o3) are connected. The outdoor fifth pipe (o5) has a second end connected to the second liquid connection pipe (4). The outdoor sixth pipe (o6) has a first end connected to a point between the two ends of the outdoor fifth pipe (o5). The outdoor sixth pipe (o6) has a second end connected to the first liquid connection pipe (2). The outdoor seventh pipe (o7) has a first end connected to a point between the two ends of the outdoor sixth pipe (o6). The outdoor seventh pipe (o7) has a second end connected to a point between the two ends of the outdoor second pipe (o2).

<Outdoor Expansion Valve>

The outdoor expansion valve (14) is connected to the outdoor first pipe (o1). The outdoor expansion valve (14) is located at a refrigerant path between the gas-liquid separator (15) and the outdoor heat exchanger (13) functioning as a radiator when a utilization-side heat exchanger (54, 64) functions as an evaporator. The outdoor expansion valve (14) is a decompression mechanism configured to decompress the refrigerant. The outdoor expansion valve (14) is a heat source-side expansion mechanism. The outdoor expansion valve (14) is an opening degree-adjustable electronic expansion valve.

<Gas-Liquid Separator>

The gas-liquid separator (15) serves as a container for storing the refrigerant (i.e., a refrigerant storage reservoir). The gas-liquid separator (15) is disposed downstream of the radiator (13, 54) in the refrigerant circuit. The gas-liquid separator (15) separates the refrigerant into the gas refrigerant and the liquid refrigerant. The gas-liquid separator (15) has the top portion to which the second end of the outdoor second pipe (o2) and a first end of a degassing pipe (37) are connected. The degassing pipe (37) has a second end connected to a point between two ends of an injection pipe (38). A degassing valve (39) is connected to the degassing pipe (37). The degassing valve (39) is an opening degree-changeable electronic expansion valve.

<Cooling Heat Exchanger>

The cooling heat exchanger (16) is configured to cool the refrigerant (mainly the liquid refrigerant) separated by the gas-liquid separator (15). The cooling heat exchanger (16) includes a first refrigerant flow path (16*a*) and a second refrigerant flow path (16*b*). The first refrigerant flow path (16*a*) is connected to a point between the two ends of the outdoor fourth pipe (o4). The second refrigerant flow path (16*b*) is connected to a point between the two ends of the injection pipe (38).

The injection pipe (38) has a first end connected to a point between the two ends of the outdoor fifth pipe (o5). The injection pipe (38) has a second end connected to the first suction pipe (21*a*) of the first compressor (21). In other words, the injection pipe (38) has a second end connected to an intermediate-pressure portion of the compression unit (20). The injection pipe (38) is provided with a reducing valve (40) located upstream of the second refrigerant flow path (16*b*). The reducing valve (40) is an opening degree-changeable expansion valve.

The cooling heat exchanger (16) causes the refrigerant flowing through the first refrigerant flow path (16*a*) to exchange heat with the refrigerant flowing through the second refrigerant flow path (16*b*). The refrigerant decompressed by the reducing valve (40) flows through the second refrigerant flow path (16*b*). Therefore, the cooling heat exchanger (16) cools the refrigerant flowing through the first refrigerant flow path (16*a*).

<Intermediate Heat Exchanger>

The intermediate heat exchanger (17) is connected to an intermediate flow path (41). The intermediate flow path (41) has a first end connected to the second discharge pipe (22*b*) connected to the second compressor (22) and the third discharge pipe (23*b*) connected to the third compressor (23). The intermediate flow path (41) has a second end connected to the first suction pipe (21*a*) connected to the first compressor (21). In other words, the intermediate flow path (41) has a second end connected to the intermediate-pressure portion of the compression unit (20).

The intermediate heat exchanger (17) is a fin-and-tube air heat exchanger. A cooling fan (17*a*) is disposed near the intermediate heat exchanger (17). The intermediate heat exchanger (17) causes the refrigerant flowing therethrough to exchange heat with outdoor air (a heating medium) provided by the cooling fan (17*a*).

The intermediate heat exchanger (17) functions as a cooler that cools the refrigerant discharged from the lower-stage compression element (22, 23) and supplies the refrigerant thus cooled to the higher-stage compression element (21) for the two-stage compression by the compression unit (20).

<Oil Separation Circuit>

The outdoor circuit (11) includes an oil separation circuit (42). The oil separation circuit (42) includes an oil separator (43), a first oil return pipe (44), a second oil return pipe (45), and a third oil return pipe (46). The oil separator (43) is connected to the first discharge pipe (21*b*) connected to the first compressor (21). The oil separator (43) is configured to separate oil from the refrigerant discharged from the compression unit (20). The first oil return pipe (44) has an inlet end communicating with the oil separator (43). The first oil return pipe (44) has an outlet end connected to the second suction pipe (22*a*) connected to the second compressor (22). The second oil return pipe (45) has an inlet end communicating with the oil separator (43). The second oil return pipe (45) has an outlet end connected to an inlet end of the intermediate flow path (41). The third oil return pipe (46) includes a main return pipe (46*a*), a cooling facility-side branch pipe (46*b*), and an indoor-side branch pipe (46*c*). The main return pipe (46*a*) has an inlet end communicating with the oil separator (43). The main return pipe (46*a*) has an outlet end to which an inlet end of the cooling facility-side branch pipe (46*b*) and an inlet end of the indoor-side branch pipe (46*c*) are connected. The cooling facility-side branch pipe (46*b*) has an outlet end communicating with an oil reservoir in a casing of the second compressor (22). The indoor-side branch pipe (46*c*) has an outlet end communicating with an oil reservoir in a casing of the third compressor (23).

A first oil regulation valve (47*a*) is connected to the first oil return pipe (44). A second oil regulation valve (47*b*) is connected to the second oil return pipe (45). A third oil regulation valve (47*c*) is connected to the cooling facility-side branch pipe (46*b*). A fourth oil regulation valve (47*d*) is connected to the indoor-side branch pipe (46*c*).

The oil separated by the oil separator (43) is returned to the second compressor (22) via the first oil return pipe (44).

The oil separated by the oil separator (43) is returned to the third compressor (23) via the second oil return pipe (45). The oil separated by the oil separator (43) is returned to the oil reservoir in the casing of each of the second compressor (22) and the third compressor (23) via the third oil return pipe (46).

<Check Valve>

The outdoor circuit (11) includes a first check valve (CV1), a second check valve (CV2), a third check valve (CV3), a fourth check valve (CV4), a fifth check valve (CV5), a sixth check valve (CV6), a seventh check valve (CV7), an eighth check valve (CV8), a ninth check valve (CV9), and a tenth check valve (CV10). The first check valve (CV1) is connected to the first discharge pipe (21*b*). The second check valve (CV2) is connected to the second discharge pipe (22*b*). The third check valve (CV3) is connected to the third discharge pipe (23*b*). The fourth check valve (CV4) is connected to the outdoor second pipe (o2). The fifth check valve (CV5) is connected to the outdoor third pipe (o3). The sixth check valve (CV6) is connected to the outdoor sixth pipe (o6). The seventh check valve (CV7) is connected to the outdoor seventh pipe (o7). The eighth check valve (CV8) is connected to the first bypass passage (21*c*). The ninth check valve (CV9) is connected to the second bypass passage (22*c*). The tenth check valve (CV10) is connected to the third bypass passage (23*c*). These check valves (CV1 to CV10) each allow the flow of the refrigerant in a direction indicated by an arrow in FIG. 1 and prohibit the flow of the refrigerant in the opposite direction to the direction indicated by the arrow in FIG. 1.

<Indoor Unit>

The indoor unit (50) is a utilization-side unit to be installed indoors. The indoor unit (50) includes an indoor fan (52) and an indoor circuit (51) (which is an example of a utilization-side circuit). The indoor circuit (51) has a liquid end to which the first liquid connection pipe (2) is connected. The indoor circuit (51) has a gas end to which the first gas connection pipe (3) is connected.

The indoor circuit (51) includes, as the constituent elements of the refrigerant circuit (6), an indoor expansion valve (53) and an indoor heat exchanger (54) arranged in this order from the liquid end toward the gas end. The indoor expansion valve (53) is a first utilization-side expansion mechanism. The indoor expansion valve (53) is an opening degree-changeable electronic expansion valve.

The indoor heat exchanger (54) is a first utilization-side heat exchanger. The indoor heat exchanger (54) is a fin-and-tube air heat exchanger. The indoor fan (52) is disposed near the indoor heat exchanger (54). The indoor fan (52) is configured to provide indoor air. The indoor heat exchanger (54) causes the refrigerant flowing therethrough to exchange heat with the indoor air provided by the indoor fan (52).

<Cooling Facility Unit>

The cooling facility unit (60) is a utilization-side unit configured to cool the inside of the refrigeration facility. The cooling facility unit (60) includes a cooling facility fan (62) and a cooling facility circuit (61) (which is an example of a utilization-side circuit). The cooling facility circuit (61) has a liquid end to which the second liquid connection pipe (4) is connected. The cooling facility circuit (61) has a gas end to which the second gas connection pipe (5) is connected.

The cooling facility circuit (61) includes, as the constituent elements of the refrigerant circuit (6), a cooling facility expansion valve (63) and a cooling facility heat exchanger (64) arranged in this order from the liquid end toward the gas end. The cooling facility expansion valve (63) is a second utilization-side expansion valve. The cooling facility expansion valve (63) serves as an opening degree-changeable electronic expansion valve.

The cooling facility heat exchanger (64) is a second utilization-side heat exchanger. The cooling facility heat exchanger (64) is a fin-and-tube air heat exchanger. The cooling facility fan (62) is disposed near the cooling facility heat exchanger (64). The cooling facility fan (62) is configured to provide inside air. The cooling facility heat exchanger (64) causes the refrigerant flowing therethrough to exchange heat with the inside air provided by the cooling facility fan (62).

<Sensor>

The refrigeration apparatus (1) includes various sensors. The sensors include a high-pressure sensor (71), a high-pressure temperature sensor (72), a refrigerant temperature sensor (73), and an indoor temperature sensor (74). The high-pressure sensor (71) is configured to detect a pressure of the refrigerant discharged from the first compressor (21) (i.e., a pressure (HP) of the high-pressure refrigerant). The high-pressure temperature sensor (72) is configured to detect a temperature of the refrigerant discharged from the first compressor (21). The refrigerant temperature sensor (73) is configured to detect a temperature of the refrigerant at an outlet of the indoor heat exchanger (54) functioning as a radiator. The indoor temperature sensor (74) is configured to detect a temperature of indoor air in a target space (an indoor space) where the indoor unit (50) is installed.

The sensors also include an intermediate-pressure sensor (75), an intermediate-pressure refrigerant temperature sensor (76), a first suction pressure sensor (77), a first suction temperature sensor (78), a second suction pressure sensor (79), a second suction temperature sensor (80), an outside temperature sensor (81), a liquid refrigerant pressure sensor (81), and a liquid refrigerant temperature sensor (82). The intermediate-pressure sensor (75) is configured to detect a pressure of the refrigerant sucked in the first compressor (21) (i.e., a pressure (MP) of the intermediate-pressure refrigerant). The intermediate-pressure refrigerant temperature sensor (76) is configured to detect a temperature of the refrigerant sucked in the first compressor (21) (i.e., a temperature (Ts1) of the intermediate-pressure refrigerant). The first suction pressure sensor (77) is configured to detect a pressure (LP1) of the refrigerant sucked in the second compressor (22). The first suction temperature sensor (78) is configured to detect a temperature (Ts2) of the refrigerant sucked in the second compressor (22). The second suction pressure sensor (79) is configured to detect a pressure (LP2) of the refrigerant sucked in the third compressor (23). The third suction temperature sensor (80) is configured to detect a temperature (Ts3) of the refrigerant sucked in the third compressor (23). The outside temperature sensor (81) is configured to detect a temperature (Ta) of the outdoor air. The liquid refrigerant pressure sensor (82) is configured to detect a pressure of the liquid refrigerant flowing out of the gas-liquid separator (15), that is, a substantial pressure of the refrigerant in the gas-liquid separator (15). The liquid refrigerant temperature sensor (83) is configured to detect a temperature of the liquid refrigerant flowing out of the gas-liquid separator (15), that is, a substantial temperature of the refrigerant in the gas-liquid separator (15).

In the refrigeration apparatus (1), examples of physical quantities to be detected by other sensors (not illustrated) may include, but not limited to, a temperature of the high-pressure refrigerant, a temperature of the refrigerant in the outdoor heat exchanger (13), a temperature of the refrigerant in the cooling facility heat exchanger (64), and a temperature of the inside air.

<Controller>

Figure 2:
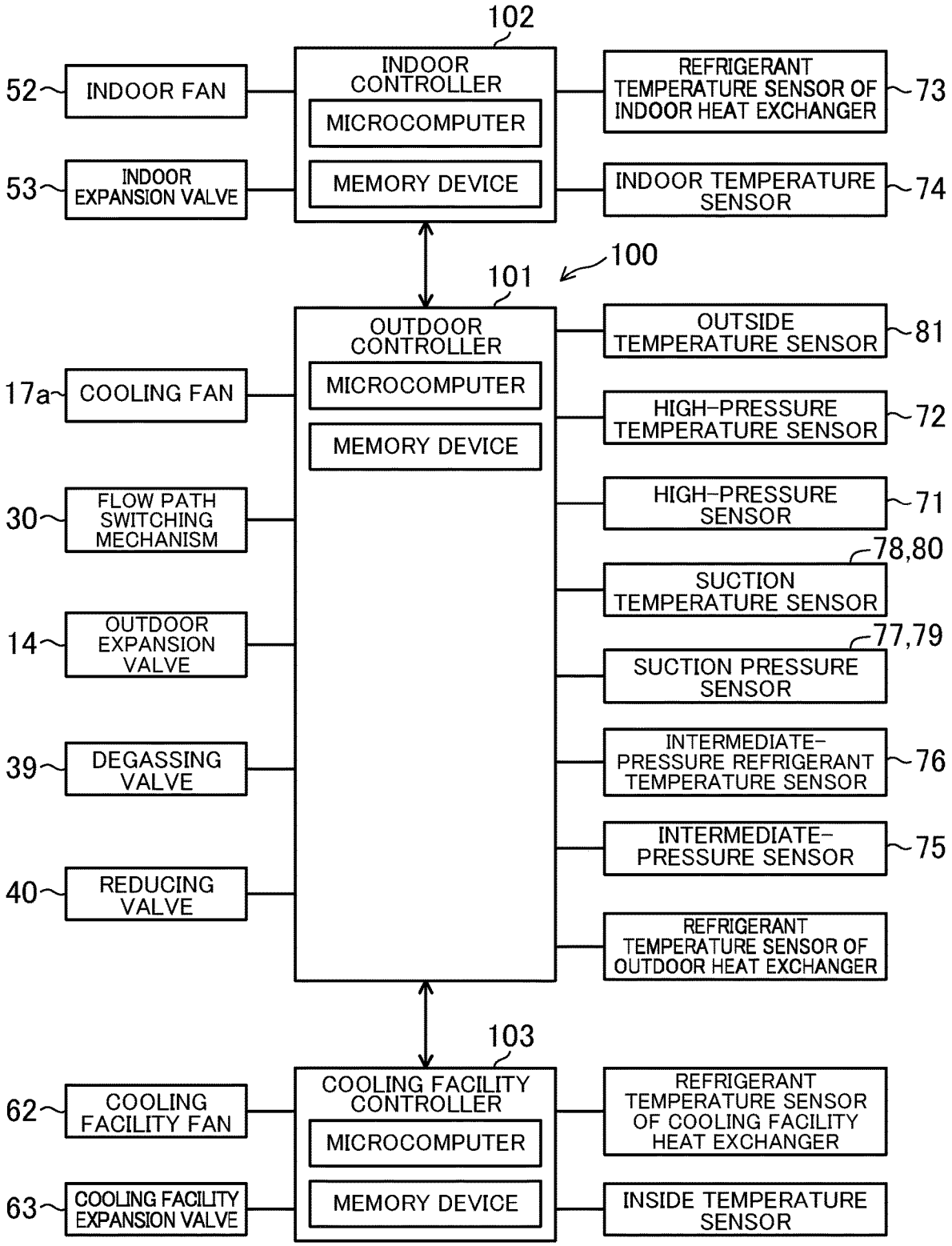
FIG. 2 is a block diagram of a relationship among a controller, various sensors, and constituent components of a refrigerant circuit.

The controller (100) is an example of a control unit. The controller (100) includes a microcomputer mounted on a control board, and a memory device (specifically, a semiconductor memory) storing software for operating the microcomputer. The controller (100) is configured to control the respective components of the refrigeration apparatus (1), based on an operation command and a detection signal from a sensor. The controller (100) controls the respective components, thereby changing an operation of the refrigeration apparatus (1). As illustrated in FIG. 2, the controller (100) is constituted of an outdoor controller (101) in the outdoor unit (10), an indoor controller (102) in the indoor unit (50), and a cooling facility controller (103) in the cooling facility unit (60). The outdoor controller (101) is configured to control an action of the outdoor circuit (11). The indoor controller (102) is configured to control an action of the indoor circuit (51). The outdoor controller (101) and the indoor controller (102) are capable of communicating with each other. The cooling facility controller (103) is configured to control an action of the cooling facility circuit (61). The outdoor controller (101) and the cooling facility controller (103) are capable of communicating with each other. The controller (100) is connected via communication lines to various sensors including a temperature sensor configured to detect a temperature of the high-pressure refrigerant in the refrigerant circuit (6). The controller (100) is also connected via communication lines to the constituent components, such as the first compressor (21), the second compressor (22), and the third compressor (23), of the refrigerant circuit (6).

The controller (100) is configured to control an action of the refrigerant circuit (6). Specifically, when a stop condition of the indoor unit (50) is satisfied, the indoor controller (102) sends a thermo-off request. When a stop condition of the cooling facility unit (60) is satisfied, the cooling facility controller (103) sends a thermo-off request. In the following, a description will be given of the case where the indoor controller (102) sends a thermo-off request, as an example. When the outdoor controller (101) receives the thermo-off request from the indoor controller (102), then the outdoor controller (101) performs a pump-down action of recovering (at least a part of) the refrigerant from the indoor unit (50) and returning the refrigerant thus recovered to the outdoor unit (10). When a pump-down prohibition condition (which is an example of a first condition) indicating that the pressure at the heat source-side unit (10) is equal to or more than a critical pressure of the refrigerant is satisfied, the outdoor controller (101) performs a pump-down prohibition action of prohibiting the pump-down action and stopping the compression unit (20) without returning the refrigerant to the outdoor unit (10). Specifically, when the pump-down prohibition condition indicating that the internal pressure of the gas-liquid separator (15) of the heat source-side unit (10) is equal to or more than the critical pressure (which is an example of a first pressure) of the refrigerant is satisfied, the outdoor controller (101) performs the pump-down prohibition action of prohibiting the pump-down action and stopping the compression unit (20) without returning the refrigerant to the outdoor unit (10).

The outdoor controller (101) determines that the pump-down prohibition condition is satisfied, when the outside temperature (Ta) detected by the outside temperature sensor (81) is higher than a predetermined temperature. The outdoor controller (101) also determines that the pump-down prohibition condition is satisfied, when the high pressure (HP) at the refrigerant circuit (6) has a value more than a predetermined value. This predetermined value is obtained by adding, in a case where the internal pressure of the gas-liquid separator (15) is equal to the critical pressure of the refrigerant, a difference in pressure between the high-pressure sensor (71) and the liquid refrigerant pressure sensor (82) (i.e., a pressure value corresponding to a pressure loss of the refrigerant) to a value of the critical pressure. This is because the high pressure (HP) detected by the high-pressure sensor (71) is higher by the pressure loss than the internal pressure of the gas-liquid separator (15).

In starting to perform the pump-down action, the outdoor controller (101) sends a first instruction to the indoor controller (102) such that the indoor controller (102) closes the indoor expansion valve (53). When the indoor controller (102) receives the first instruction, then the indoor controller (102) closes the indoor expansion valve (53). In the pump-down operation, therefore, the indoor expansion valve (53) is closed, and the refrigerant in the indoor heat exchanger (54) and first gas connection pipe (3) located downstream of the indoor expansion valve (53) is thus returned to the outdoor unit (10).

In performing the pump-down prohibition action, the outdoor controller (101) sends a second instruction to the indoor controller (102) such that the indoor controller (102) opens the indoor expansion valve (53) or maintains the indoor expansion valve (53) at an open state. When the indoor controller (102) receives the second instruction, then the indoor controller (102) opens the indoor expansion valve (53). In the pump-down prohibition action, therefore, the compression unit (20) stops with the indoor expansion valve (53) opened.

In performing the pump-down action, the outdoor controller (101) adjusts the opening degree of the outdoor expansion valve (14) such that the pressure of the refrigerant stored in the gas-liquid separator (15) becomes lower than the critical pressure. In other words, when the pressure of the refrigerant in the gas-liquid separator (15) is close to the critical pressure, the outdoor controller (101) increases the opening degree of the outdoor expansion valve (14) to reduce the pressure of the refrigerant flowing into the gas-liquid separator (15).

The outdoor controller (101) is capable of performing a liquid compression avoidance action (which is an example of a first action) of stopping the second and third compressors (22, 23) constituting the lower-stage compression element and operating the first compressor (21) constituting the higher-stage compression element. The outdoor controller (101) performs the liquid compression avoidance action when determining that the liquid refrigerant is stored in the indoor heat exchanger (54) or the pipe in the indoor unit (50). This is because a pressure rise is caused when the liquid refrigerant is stored in the pipe. The outdoor controller (101) determines that the liquid refrigerant is stored in the indoor heat exchanger (54) or the pipe, when a suction pressure of the compression unit (20) has a value more than a predetermined value, for example. The suction pressure is detected by the suction pressure sensor (77, 79). Alternatively, a pressure detected by the intermediate pressure sensor (75) may be used as the suction pressure since the refrigerant detours around the lower-stage compression element (22, 23) in a state in which the compression unit (20) stops. Also in a case where the outdoor controller (101) determines that the refrigerant is in a wet state, from the temperature and pressure of the refrigerant at the outlet of the indoor heat exchanger (54), the outdoor controller (101)

determines that the liquid refrigerant is stored in the indoor heat exchanger (54) or the pipe, and performs the liquid compression avoidance action.

The outdoor controller (101) is capable of performing the liquid compression avoidance action at startup of the compression unit (20) after the indoor expansion valve (53) is opened, in a state in which a predetermined condition is satisfied in the course of or after the stop of the compression unit (20). This predetermined condition includes a condition that the high pressure at the refrigerant circuit (6) (specifically, the pressure of the refrigerant in the gas-liquid separator (15)) exceeds the critical pressure (the first pressure). Specifically, the outdoor controller (101) is capable of performing the liquid compression avoidance action at startup of the compression unit (20) after the pump-down action.

In the liquid compression avoidance action, the liquid refrigerant in the indoor unit (50) flows into the outdoor unit. In the outdoor unit, since only the first compressor (21) operates, the refrigerant flows into the intermediate heat exchanger (17) via the third bypass passage (23*c*). At this time, since the cooling fan (17*a*) rotates, the intermediate heat exchanger evaporates the liquid refrigerant by causing the liquid refrigerant to exchange heat with outdoor air. In other words, the intermediate heat exchanger (17) does not function as a cooler for cooling the refrigerant, but functions as an evaporator for heating and evaporating the liquid refrigerant. The refrigerant, which has been evaporated by the intermediate heat exchanger (17), is sucked into and compressed by the first compressor (21). The refrigerant then flows into and is stored in each of the outdoor heat exchanger (13) and the gas-liquid separator (15).

When the suction pressure of the compression unit (20) is equal to or less than the predetermined value at startup of the compression unit (20), the outdoor controller (101) determines that the refrigerant sucked in the compression unit (20) is in a superheated state. At this time, the outdoor controller (101) is capable of performing a normal startup action (which is an example of a second action) of operating the third compressor (23) constituting the lower-stage compression element (22, 23) and the first compressor (21) constituting the higher-stage compression element (21) and causing the intermediate heat exchanger (17) to function as a cooler. In addition, when the suction pressure of the compression unit (20) has a value equal to or less than the predetermined value in the liquid compression avoidance action, the outdoor controller (101) makes a transition from the liquid compression avoidance action to the normal startup action of operating both the third compressor (23) and the first compressor (21) and causing the intermediate heat exchanger (17) to function as a cooler. In a state in which the intermediate heat exchanger (17) functions as a cooler, when the outside temperature is low, for example, the outdoor controller (101) reduces the number of rotations of the cooling fan (17*a*).

When the suction pressure of the compression unit (20) has a value equal to or less than the predetermined value in the liquid compression avoidance action, the outdoor controller (101) causes the indoor controller (102) to adjust the opening degree of the indoor expansion valve (53), based on the degree of superheating of the refrigerant at the outlet of the indoor heat exchanger (54). With this configuration, when the suction pressure of the compression unit (20) decreases, the indoor controller (102) closes the indoor expansion valve (53) to adjust the degree of superheating of the refrigerant at the outlet of the indoor heat exchanger (54).

—Operations and Actions—

Next, a specific description will be given of operations to be carried out by the refrigeration apparatus (1) and actions to be performed by the refrigeration apparatus (1). The operations of the refrigeration apparatus (1) include a cooling-facility operation, a cooling operation, a cooling and cooling-facility operation, a heating operation, a heating and cooling-facility operation, a heating and cooling-facility heat recovery operation, a heating and cooling-facility waste heat operation, and a defrosting operation. The operations of the refrigeration apparatus (1) also include the pump-down action and the pump-down prohibition action to be performed for temporarily stopping the indoor unit (50) as the utilization-side unit, that is, to be performed in a thermo-off state, and the liquid compression avoidance action (the first action) and the normal startup action (the second action) to be performed after the pump-down prohibition action.

During the cooling-facility operation, the cooling facility unit (60) operates, while the indoor unit (50) stops. During the cooling operation, the cooling facility unit (60) stops, while the indoor unit (50) cools the indoor air. During the cooling and cooling-facility operation, the cooling facility unit (60) operates, while the indoor unit (50) cools the indoor air. During the heating operation, the cooling facility unit (60) stops, while the indoor unit (50) heats the indoor air. During the heating and cooling-facility operation, the heating and cooling-facility heat recovery operation, and the heating and cooling-facility waste heat operation, the cooling facility unit (60) operates, while the indoor unit (50) heats the indoor air. During the defrosting operation, the cooling facility unit (60) operates, while frost on a surface of the outdoor heat exchanger (13) is melted.

The heating and cooling-facility operation is carried out on a condition that a relatively large heating capacity is required for the indoor unit (50). The heating and cooling-facility waste heat operation is carried out on a condition that a relatively small heating capacity is required for the indoor unit (50). The heating and cooling-facility heat recovery operation is carried out on a condition that the heating capacity required for the indoor unit (50) falls within a range between a heating capacity required in the heating operation and a cooling capacity required in the cooling-facility operation (i.e., on a condition that the balance between the cooling capacity required in the cooling-facility operation and the heating capacity required in the heating operation is achieved).

<Cooling-Facility Operation>

Figure 3:
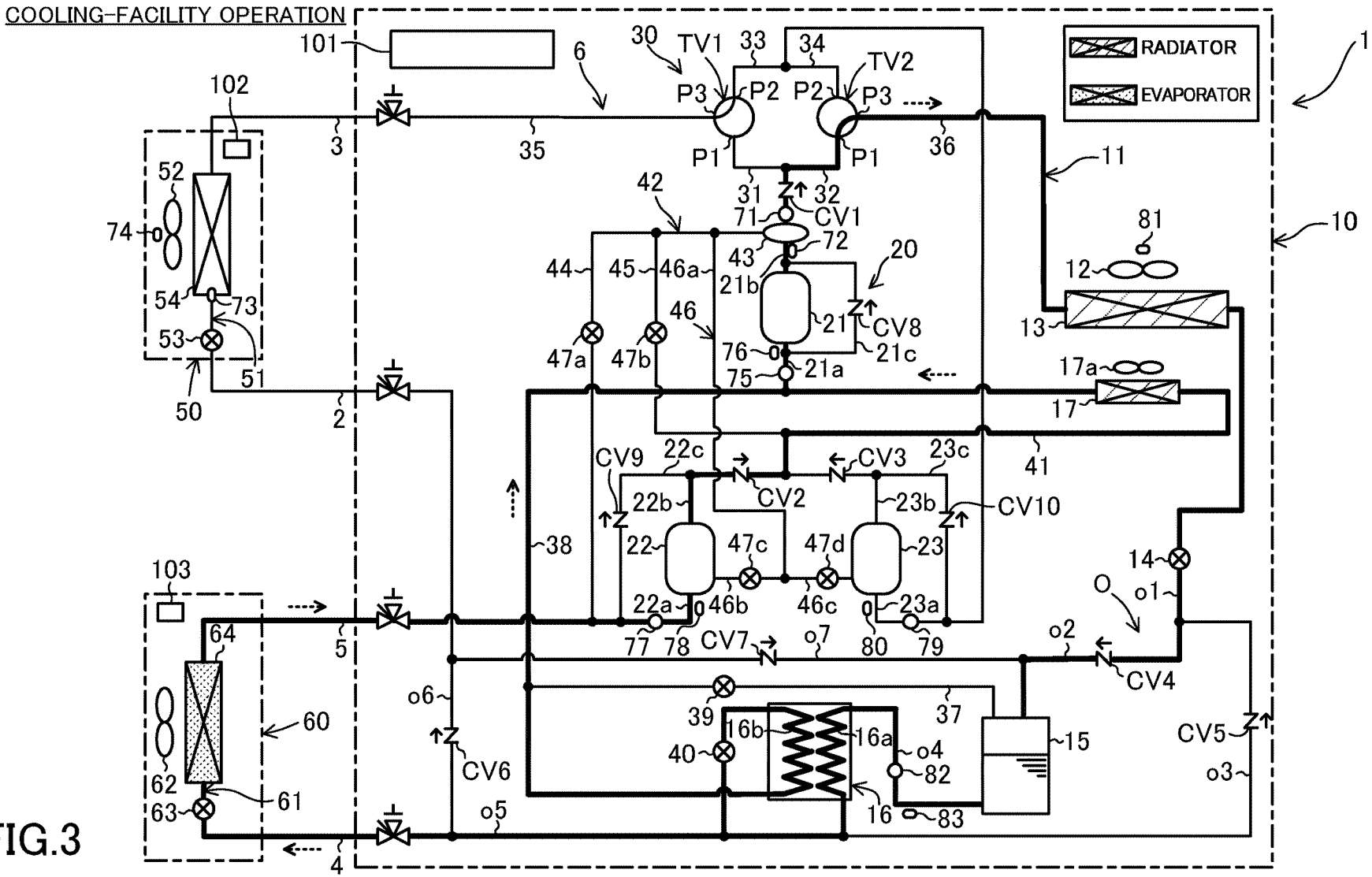
FIG. 3 is a diagram (equivalent to FIG. 1) of a flow of a refrigerant during a cooling-facility operation.

During the cooling-facility operation illustrated in FIG. 3, the first three-way valve (TV1) is in the second state, while the second three-way valve (TV2) is in the first state. The outdoor expansion valve (14) is opened at a predetermined opening degree. The opening degree of the cooling facility expansion valve (63) is adjusted by superheating control. The indoor expansion valve (53) is fully closed. The opening degree of the reducing valve (40) is appropriately adjusted. The outdoor fan (12), the cooling fan (17*a*), and the cooling facility fan (62) operate, while the indoor fan (52) stops. The first compressor (21) and the second compressor (22) operate, while the third compressor (23) stops. During the cooling-facility operation, a refrigeration cycle is achieved, in which the compression unit (20) compresses the refrigerant, the outdoor heat exchanger (13) causes the refrigerant to dissipate heat, and the cooling facility heat exchanger (64) evaporates the refrigerant.

As illustrated in FIG. 3, the second compressor (22) compresses the refrigerant, the intermediate heat exchanger (17) cools the refrigerant, and the first compressor (21) sucks in the refrigerant. After the first compressor (21) compresses the refrigerant, the outdoor heat exchanger (13) causes the refrigerant to dissipate heat. The refrigerant then flows through the gas-liquid separator (15). Thereafter, the cooling heat exchanger (16) cools the refrigerant. After the cooling heat exchanger (16) cools the refrigerant, the cooling facility expansion valve (63) decompresses the refrigerant, and the cooling facility heat exchanger (64) evaporates the refrigerant. The inside air is thus cooled. After the cooling facility heat exchanger (64) evaporates the refrigerant, the second compressor (22) sucks in the refrigerant to compress the refrigerant again.

<Cooling Operation>

Figure 4:
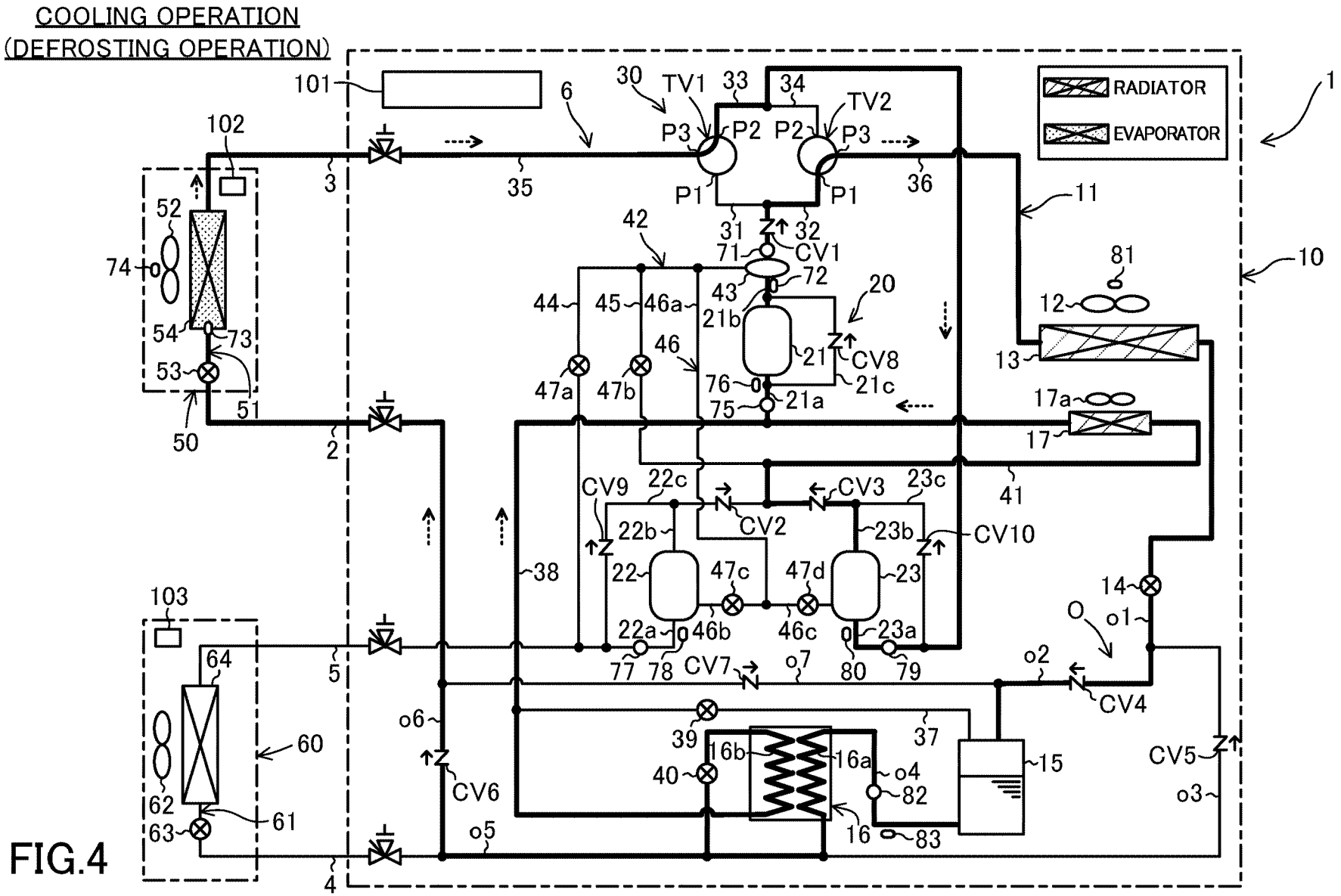
FIG. 4 is a diagram (equivalent to FIG. 1) of a flow of the refrigerant during a cooling operation.

During the cooling operation illustrated in FIG. 4, the first three-way valve (TV1) is in the second state, while the second three-way valve (TV2) is in the first state. The outdoor expansion valve (14) is opened at a predetermined opening degree. The cooling facility expansion valve (63) is fully closed. The opening degree of the indoor expansion valve (53) is adjusted by superheating control. The opening degree of the reducing valve (40) is appropriately adjusted. The outdoor fan (12), the cooling fan (17*a*), and the indoor fan (52) operate, while the cooling facility fan (62) stops. The first compressor (21) and the third compressor (23) operate, while the second compressor (22) stops. During the cooling operation, a refrigeration cycle is achieved, in which the compression unit (20) compresses the refrigerant, the outdoor heat exchanger (13) causes the refrigerant to dissipate heat, and the indoor heat exchanger (54) evaporates the refrigerant.

As illustrated in FIG. 4, the third compressor (23) compresses the refrigerant, the intermediate heat exchanger (17) cools the refrigerant, and the first compressor (21) sucks in the refrigerant. After the first compressor (21) compresses the refrigerant, the outdoor heat exchanger (13) causes the refrigerant to dissipate heat. The refrigerant then flows through the gas-liquid separator (15). Thereafter, the cooling heat exchanger (16) cools the refrigerant. After the cooling heat exchanger (16) cools the refrigerant, the indoor expansion valve (53) decompresses the refrigerant, and the indoor heat exchanger (54) evaporates the refrigerant. The indoor air is thus cooled. After the indoor heat exchanger (54) evaporates the refrigerant, the third compressor (23) sucks in the refrigerant to compress the refrigerant again.

<Cooling and Cooling-Facility Operation>

Figure 5:
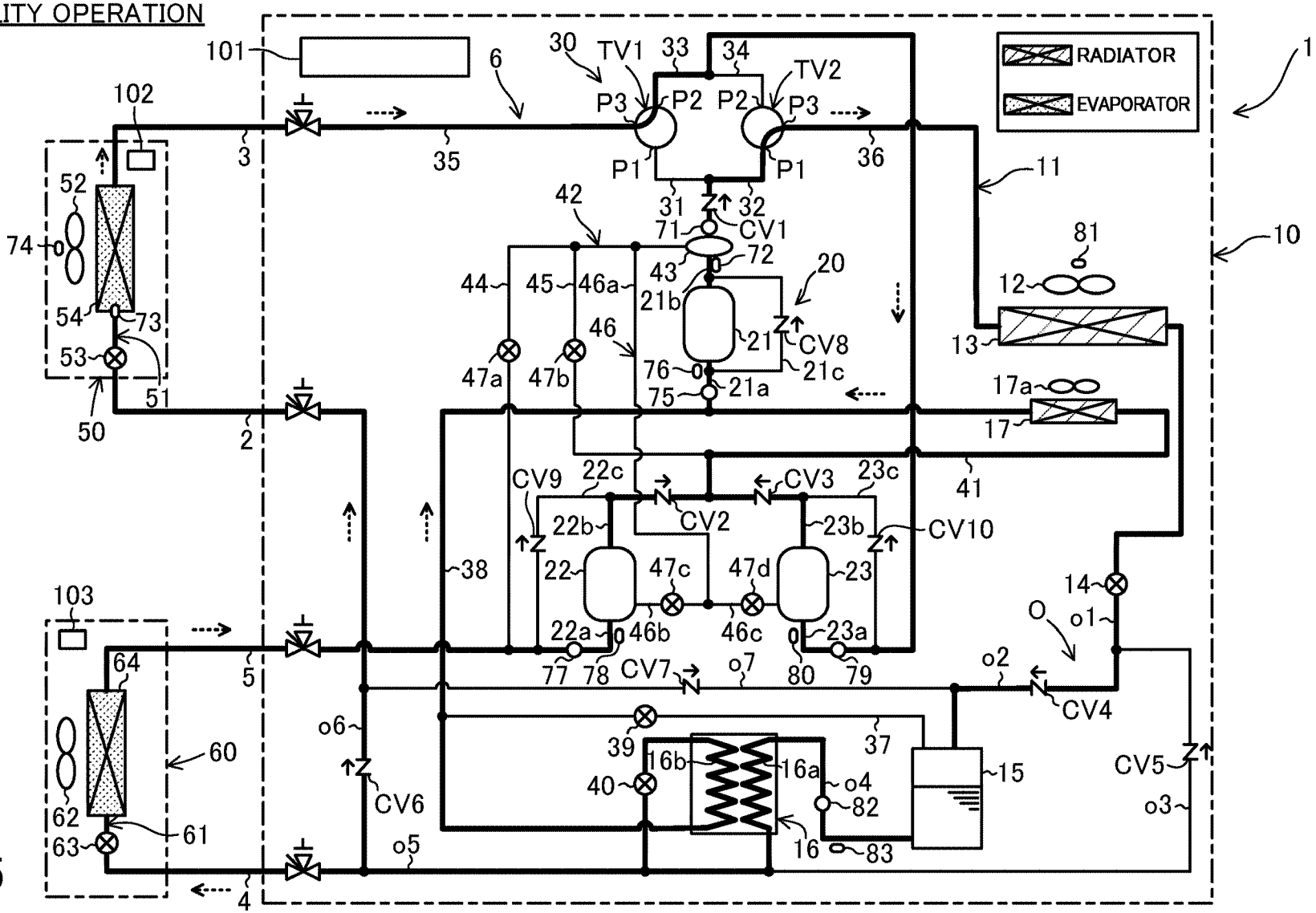
FIG. 5 is a diagram (equivalent to FIG. 1) of a flow of the refrigerant during a cooling and cooling-facility operation.

During the cooling and cooling-facility operation illustrated in FIG. 5, the first three-way valve (TV1) is in the second state, while the second three-way valve (TV2) is in the first state. The outdoor expansion valve (14) is opened at a predetermined opening degree. The opening degree of each of the cooling facility expansion valve (63) and the indoor expansion valve (53) is adjusted by superheating control. The opening degree of the reducing valve (40) is appropriately adjusted. The outdoor fan (12), the cooling fan (17*a*), the cooling facility fan (62), and the indoor fan (52) operate. The first compressor (21), the second compressor (22), and the third compressor (23) operate. During the cooling and cooling-facility operation, a refrigeration cycle is achieved, in which the compression unit (20) compresses the refrigerant, the outdoor heat exchanger (13) causes the refrigerant to dissipate heat, and each of the cooling facility heat exchanger (64) and the indoor heat exchanger (54) evaporates the refrigerant.

As illustrated in FIG. 5, each of the second compressor (22) and the third compressor (23) compresses the refrigerant, the intermediate heat exchanger (17) cools the refrigerant, and the first compressor (21) sucks in the refrigerant. After the first compressor (21) compresses the refrigerant, the outdoor heat exchanger (13) causes the refrigerant to dissipate heat. The refrigerant then flows through the gas-liquid separator (15). Thereafter, the cooling heat exchanger (16) cools the refrigerant. After the cooling heat exchanger (16) cools the refrigerant, the refrigerant is diverted into the cooling facility unit (60) and the indoor unit (50). The cooling facility expansion valve (63) decompresses the refrigerant, and the cooling facility heat exchanger (64) evaporates the refrigerant. After the cooling facility heat exchanger (64) evaporates the refrigerant, the second compressor (22) sucks in the refrigerant to compress the refrigerant again. The indoor expansion valve (53) decompresses the refrigerant, and the indoor heat exchanger (54) evaporates the refrigerant. After the indoor heat exchanger (54) evaporates the refrigerant, the third compressor (23) sucks in the refrigerant to compress the refrigerant again.

<Heating Operation>

Figure 6:
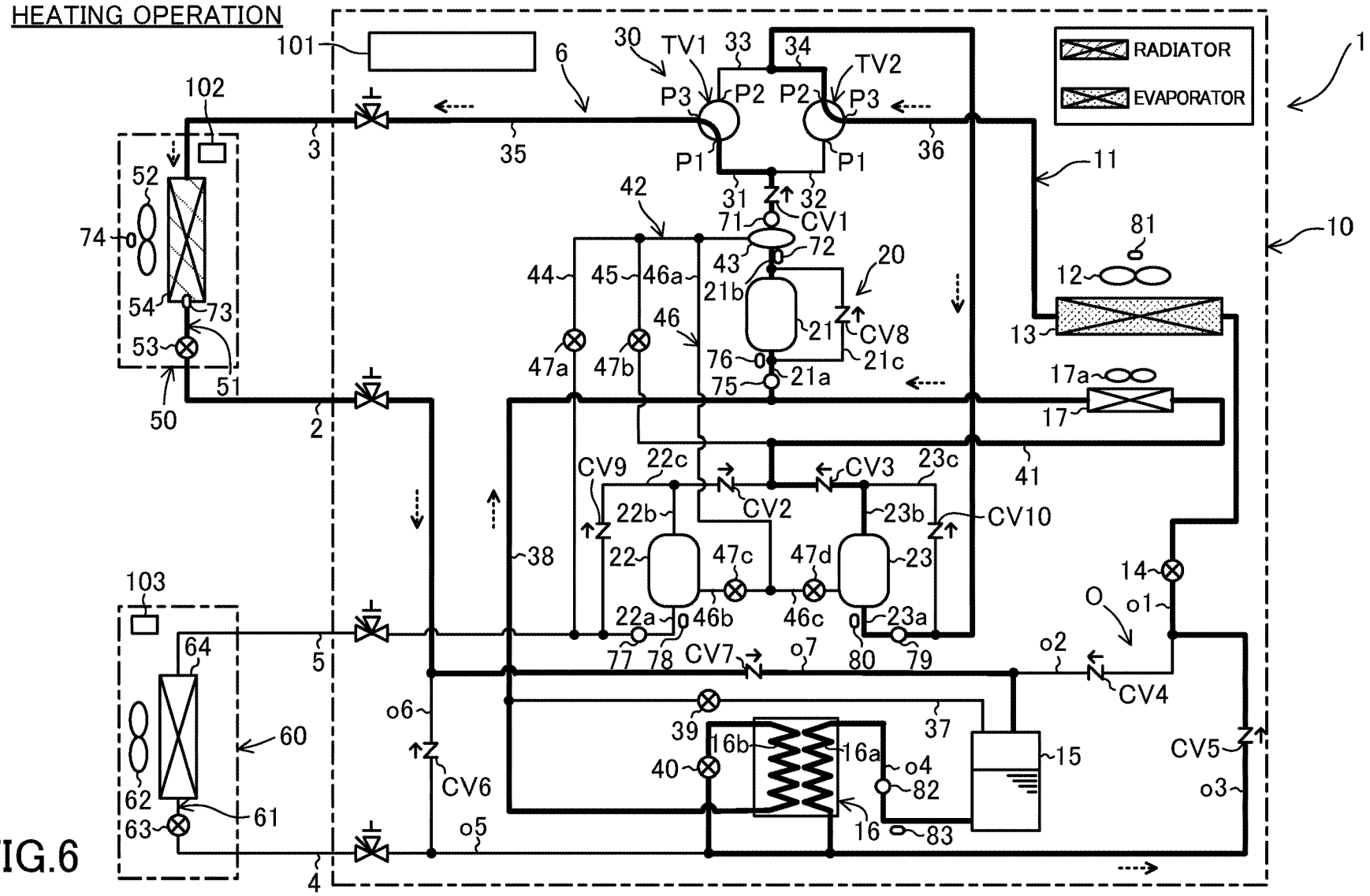
FIG. 6 is a diagram (equivalent to FIG. 1) of a flow of the refrigerant during a heating operation.

During the heating operation illustrated in FIG. 6, the first three-way valve (TV1) is in the first state, while the second three-way valve (TV2) is in the second state. The indoor expansion valve (53) is opened at a predetermined opening degree. The cooling facility expansion valve (63) is fully closed. The opening degree of the outdoor expansion valve (14) is adjusted by superheating control. The opening degree of the reducing valve (40) is appropriately adjusted. The outdoor fan (12) and the indoor fan (52) operate, while the cooling fan (17*a*) and the cooling facility fan (62) stop. The first compressor (21) and the third compressor (23) operate, while the second compressor (22) stops. During the heating operation, a refrigeration cycle is achieved, in which the compression unit (20) compresses the refrigerant, the indoor heat exchanger (54) causes the refrigerant to dissipate heat, and the outdoor heat exchanger (13) evaporates the refrigerant.

As illustrated in FIG. 6, after the third compressor (23) compresses the refrigerant, the refrigerant flows through the intermediate heat exchanger (17). The first compressor (21) then sucks in the refrigerant. After the first compressor (21) compresses the refrigerant, the indoor heat exchanger (54) causes the refrigerant to dissipate heat. The indoor air is thus heated. After the indoor heat exchanger (54) causes the refrigerant to dissipate heat, the refrigerant flows through the gas-liquid separator (15). The cooling heat exchanger (16) then cools the refrigerant. After the cooling heat exchanger (16) cools the refrigerant, the outdoor expansion valve (14) decompresses the refrigerant, and the outdoor heat exchanger (13) evaporates the refrigerant. After the outdoor heat exchanger (13) evaporates the refrigerant, the third compressor (23) sucks in the refrigerant to compress the refrigerant again.

<Heating and Cooling-Facility Operation>

Figure 7:
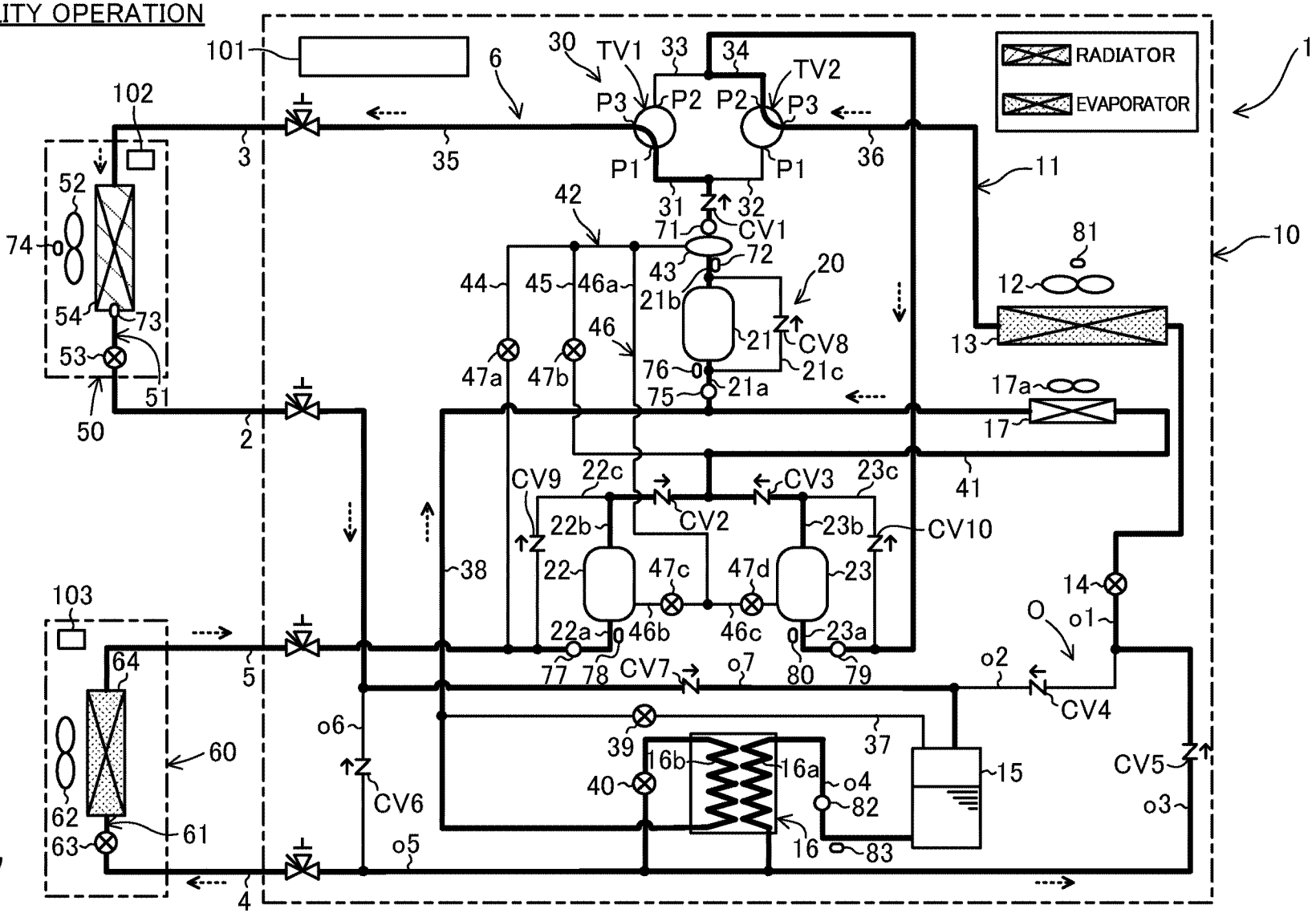
FIG. 7 is a diagram (equivalent to FIG. 1) of a flow of the refrigerant during a heating and cooling-facility operation.

During the heating and cooling-facility operation illustrated in FIG. 7, the first three-way valve (TV1) is in the first state, while the second three-way valve (TV2) is in the second state. The indoor expansion valve (53) is opened at a predetermined opening degree. The opening degree of each of the cooling facility expansion valve (63) and the outdoor expansion valve (14) is adjusted by superheating control. The opening degree of the reducing valve (40) is appropriately adjusted. The outdoor fan (12), the cooling facility fan (62), and the indoor fan (52) operate, while the cooling fan (17*a*) stops. The first compressor (21), the second compressor (22), and the third compressor (23) operate. During the heating and cooling-facility operation, a refrigeration cycle (a third refrigeration cycle) is achieved, in which the compression unit (20) compresses the refrigerant, the indoor heat exchanger (54) causes the refrigerant to dissipate heat, and each of the cooling facility heat exchanger (64) and the outdoor heat exchanger (13) evaporates the refrigerant.

As illustrated in FIG. 7, after each of the second compressor (22) and the third compressor (23) compresses the refrigerant, the refrigerant flows through the intermediate heat exchanger (17). The first compressor (21) then sucks in the refrigerant. After the first compressor (21) compresses the refrigerant, the indoor heat exchanger (54) causes the refrigerant to dissipate heat. The indoor air is thus heated. After the indoor heat exchanger (54) causes the refrigerant to dissipate heat, the refrigerant flows through the gas-liquid separator (15). The cooling heat exchanger (16) then cools the refrigerant. After the cooling heat exchanger (16) cools the refrigerant, the outdoor expansion valve (14) decompresses a part of the refrigerant, and the outdoor heat exchanger (13) evaporates the refrigerant. After the outdoor heat exchanger (13) evaporates the refrigerant, the third compressor (23) sucks in the refrigerant to compress the refrigerant again.

After the cooling heat exchanger (16) cools the refrigerant, the cooling facility expansion valve (63) decompresses the remaining refrigerant, and the cooling facility heat exchanger (64) evaporates the refrigerant. The inside air is thus cooled. After the cooling facility heat exchanger (64) evaporates the refrigerant, the second compressor (22) sucks in the refrigerant to compress the refrigerant again.

<Heating and Cooling-Facility Heat Recovery Operation>

Figure 8:
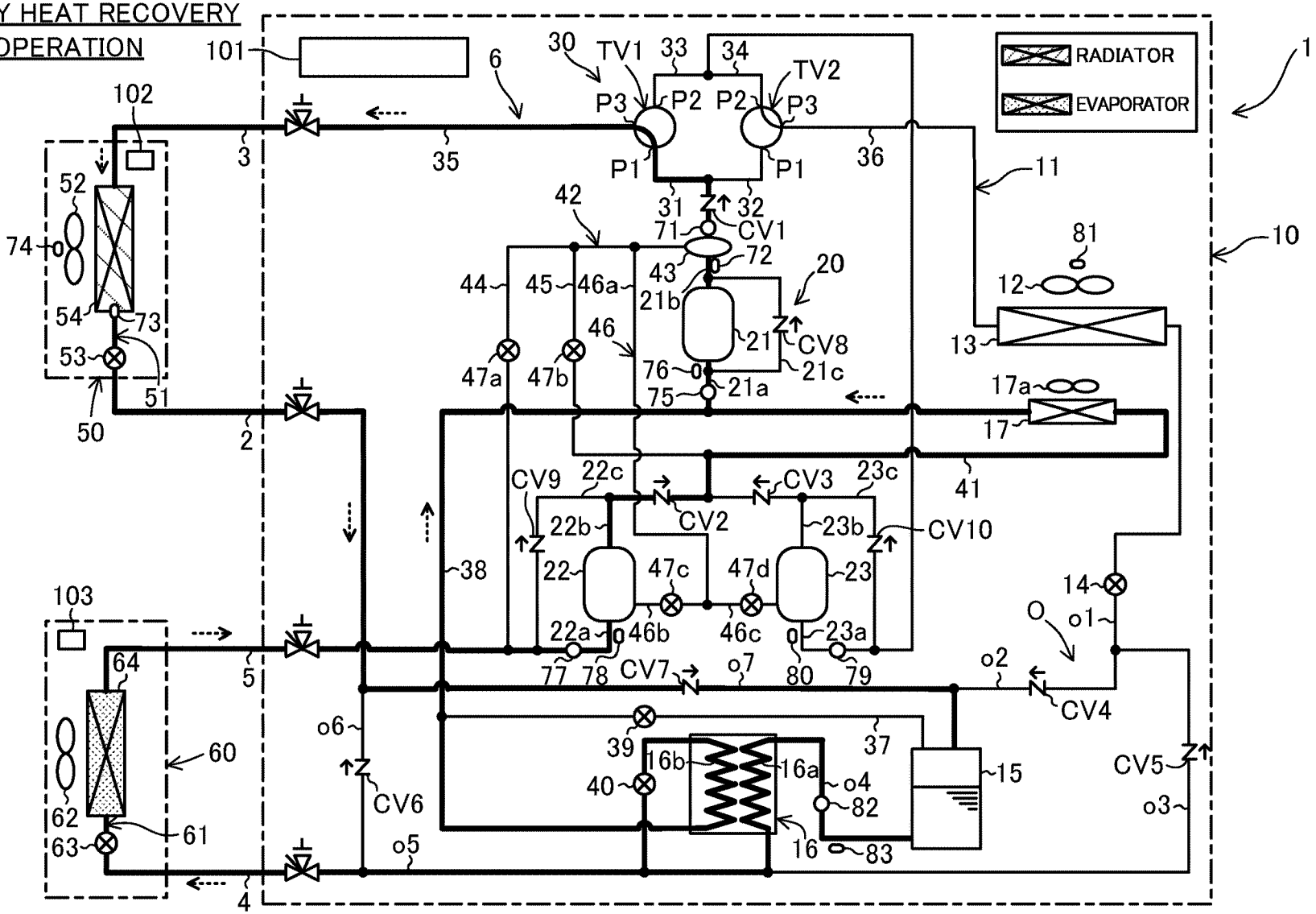
FIG. 8 is a diagram (equivalent to FIG. 1) of a flow of the refrigerant during a heating and cooling-facility heat recovery operation.

During the heating and cooling-facility heat recovery operation illustrated in FIG. 8, the first three-way valve (TV1) is in the first state, while the second three-way valve (TV2) is in the second state. The indoor expansion valve (53) is opened at a predetermined opening degree. The outdoor expansion valve (14) is fully closed. The opening degree of the cooling facility expansion valve (63) is adjusted by superheating control. The opening degree of the reducing valve (40) is appropriately adjusted. The indoor fan (52) and the cooling facility fan (62) operate, while the cooling fan (17*a*) and the outdoor fan (12) stop. The first compressor (21) and the second compressor (22) operate, while the third compressor (23) stops. During the heating and cooling-facility heat recovery operation, a refrigeration cycle (a first refrigeration cycle) is achieved, in which the compression unit (20) compresses the refrigerant, the indoor heat exchanger (54) causes the refrigerant to dissipate heat, the cooling facility heat exchanger (64) evaporates the refrigerant, and the outdoor heat exchanger (13) substantially stops.

As illustrated in FIG. 8, after the second compressor (22) compresses the refrigerant, the refrigerant flows through the intermediate heat exchanger (17). The first compressor (21) then sucks in the refrigerant. After the first compressor (21) compresses the refrigerant, the indoor heat exchanger (54) causes the refrigerant to dissipate heat. The indoor air is thus heated. After the indoor heat exchanger (54) causes the refrigerant to dissipate heat, the refrigerant flows through the gas-liquid separator (15). The cooling heat exchanger (16) then cools the refrigerant. After the cooling heat exchanger (16) cools the refrigerant, the cooling facility expansion valve (63) decompresses the refrigerant, and the cooling facility heat exchanger (64) evaporates the refrigerant. After the cooling facility heat exchanger (64) evaporates the refrigerant, the second compressor (22) sucks in the refrigerant to compress the refrigerant again.

<Heating and Cooling-Facility Waste Heat Operation>

Figure 9:
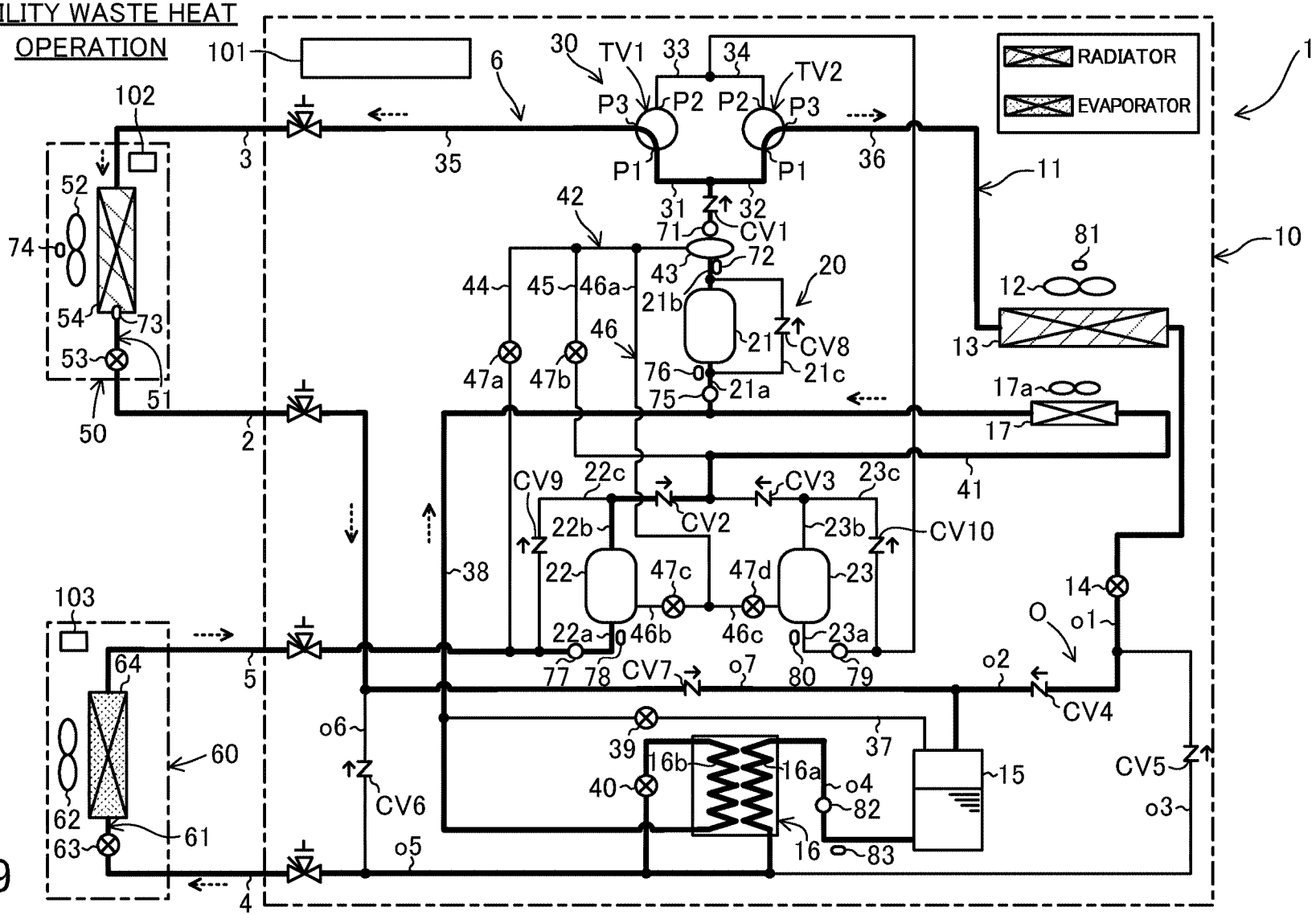
FIG. 9 is a diagram (equivalent to FIG. 1) of a flow of the refrigerant during a heating and cooling-facility waste heat operation.

During the heating and cooling-facility waste heat operation illustrated in FIG. 9, the first three-way valve (TV1) is in the first state, while the second three-way valve (TV2) is in the first state. Each of the indoor expansion valve (53) and the outdoor expansion valve (14) is opened at a predetermined opening degree. The opening degree of the cooling facility expansion valve (63) is adjusted by superheating control. The opening degree of the reducing valve (40) is appropriately adjusted. The outdoor fan (12), the cooling facility fan (62), and the indoor fan (52) operate, while the cooling fan (17*a*) stops. The first compressor (21) and the second compressor (22) operate, while the third compressor (23) stops. During the heating and cooling-facility waste heat operation, a refrigeration cycle (a second refrigeration cycle) is achieved, in which the compression unit (20) compresses the refrigerant, each of the indoor heat exchanger (54) and the outdoor heat exchanger (13) causes the refrigerant to radiate heat, and the cooling facility heat exchanger (64) evaporates the refrigerant.

As illustrated in FIG. 9, after the second compressor (22) compresses the refrigerant, the refrigerant flows through the intermediate heat exchanger (17). The first compressor (21) then sucks in the refrigerant. After the first compressor (21) compresses the refrigerant, the outdoor heat exchanger (13) causes a part of the refrigerant to dissipate heat. After the first compressor (21) compresses the refrigerant, the indoor heat exchanger (54) causes the remaining refrigerant to dissipate heat. The indoor air is thus heated. After the outdoor heat exchanger (13) causes the refrigerant to dissipate heat and the indoor heat exchanger (54) causes the refrigerant to dissipate heat, both the refrigerants flow into the gas-liquid separator (15) in a merged state. The cooling heat exchanger (16) then cools the refrigerant. After the cooling heat exchanger (16) cools the refrigerant, the cooling facility expansion valve (63) decompresses the refrigerant, and the cooling facility heat exchanger (64) evaporates the refrigerant. The inside air is thus cooled. After the cooling facility heat exchanger (64) evaporates the refrigerant, the second compressor (22) sucks in the refrigerant to compress the refrigerant again.

<Defrosting Operation>

During the defrosting operation, the respective components operate in the same manners as those during the cooling operation illustrated in FIG. 4. During the defrosting operation, each of the third compressor (23) and the first compressor (21) compresses the refrigerant, and the outdoor heat exchanger (13) causes the refrigerant to dissipate heat. The heat inside the outdoor heat exchanger (13) thus melts frost on the surface of the outdoor heat exchanger (13). After the defrosting in the outdoor heat exchanger (13), the indoor heat exchanger (54) evaporates the refrigerant, and then the third compressor (23) sucks in the refrigerant to compress the refrigerant again.

<Thermo-Off Control and Thermo-On Control>

Figure 10:
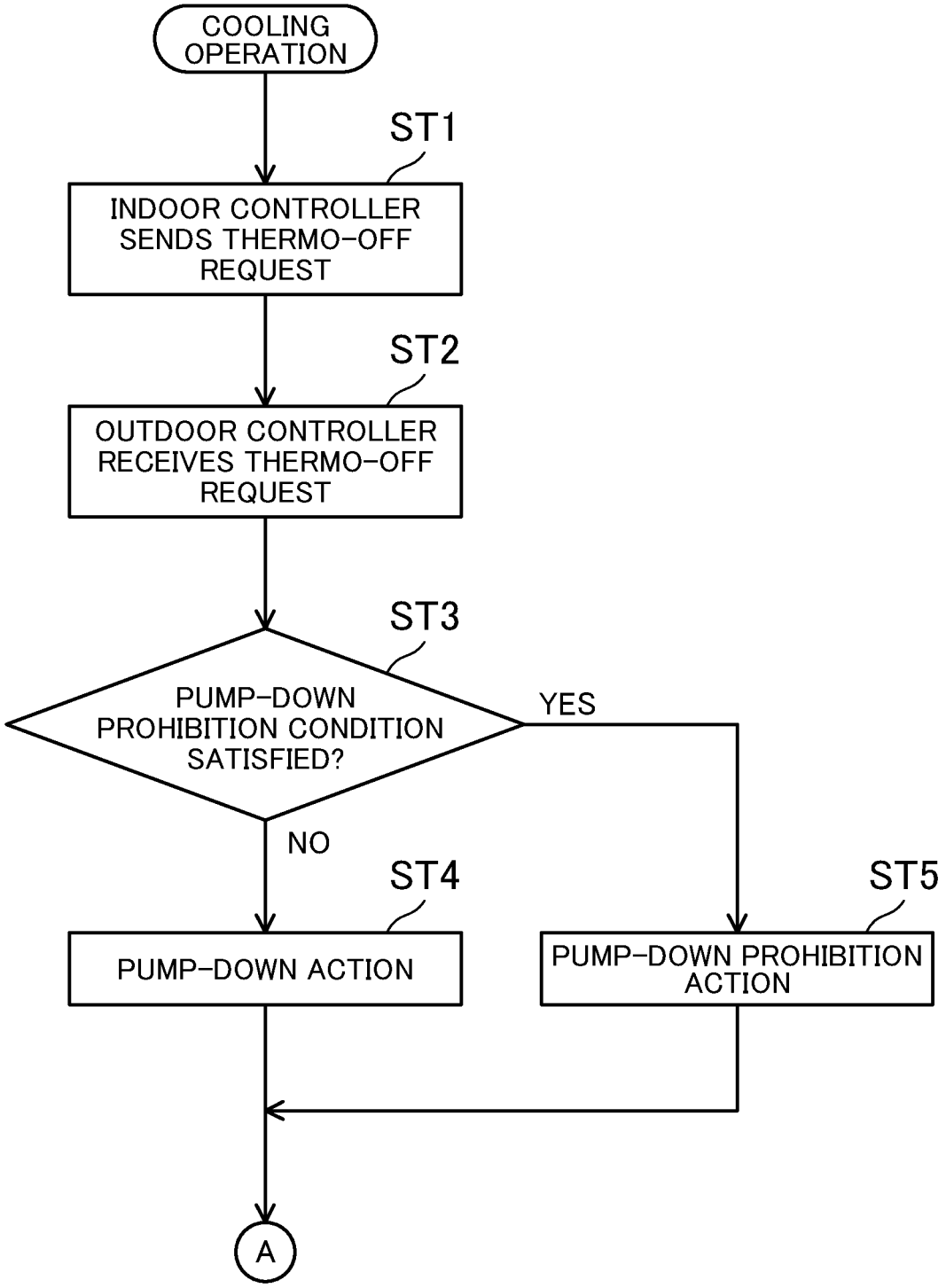
FIG. 10 is a flowchart of control by a refrigerant circuit in a thermo-off state.

With reference to a flowchart of FIG. 10, a description will be given of actions of the indoor unit (50) and cooling facility unit (60) in a thermo-off state. With reference to a flowchart of FIG. 11, a description will be given of actions of the indoor unit (50) and cooling facility unit (60) in a thermo-on state. These actions are performed in the cooling-facility operation illustrated in FIG. 3, the cooling operation illustrated in FIG. 4, and the cooling and cooling-facility operation illustrated in FIG. 5. In FIG. 10, the term "cooling operation" refers to these operations. In the following, a description will be given of the actions in the cooling operation, as a representative example.

When the stop condition of the indoor unit (50) is satisfied in the cooling operation, in step ST1 illustrated in FIG. 10, the indoor controller (102) sends a thermo-off request to the outdoor controller (101).

In step ST2, the outdoor controller (101) receives the thermo-off request from the indoor controller (102). In step ST3, the outdoor controller (101) determines whether the pump-down prohibition condition indicating that the internal pressure of the outdoor unit (10) (specifically, the gas-liquid separator (15)) is equal to or more than the critical pressure of the refrigerant is satisfied. As a result of the determination in step ST3, when the pump-down prohibition condition is not satisfied, the processing proceeds to step ST4 in which the outdoor controller (101) performs the pump-down action. On the other hand, when the pump-down prohibition condition is satisfied, the processing proceeds to step ST5 in which the outdoor controller (101) performs the pump-down prohibition action.

In step ST4, the outdoor controller (101) performs the pump-down action. Specifically, the outdoor controller (101) sends a first instruction to the indoor controller (102) such that the indoor controller (102) closes the indoor expansion valve (53). When the indoor controller (102) receives the first instruction, then the indoor controller (102) closes the indoor expansion valve (53). At this time, the outdoor controller (101) continuously operates the compression unit (20). The refrigerant in the indoor heat exchanger (54) and first gas connection pipe (3) located downstream of the indoor expansion valve (53) is thus returned to the outdoor unit (10). By the pump-down action, the refrigerant downstream of the indoor expansion valve (53) is sucked into the compression unit (20). The refrigerant is then discharged from the compression unit (20) and is stored in each of the outdoor heat exchanger (13) and the gas-liquid separator (15). In performing the pump-down action, the outdoor controller (101) adjusts the opening degree of the outdoor expansion valve (14) such that the pressure of the refrigerant stored in the gas-liquid separator (15) becomes lower than the critical pressure. Therefore, when the pressure of the refrigerant in the gas-liquid separator (15) is close to the critical pressure, the outdoor controller (101) increases the opening degree of the outdoor expansion valve (14). As a result, the outdoor controller (101) reduces the pressure of the refrigerant flowing into the gas-liquid separator (15). This configuration thus suppresses a pressure rise in the gas-liquid separator (15). Since the indoor expansion valve (53) is closed during the pump-down action, the refrigerant in the outdoor unit (10) hardly flows into the indoor unit (50). When a predetermined condition is satisfied in the pump-down action, the compression unit (20) stops. The predetermined condition includes a condition to be determined that the recovery of the refrigerant from the indoor unit (50) is almost completed, for example, a condition that the suction pressure of the compression unit (20) has a value equal to or less than the predetermined value.

As a result of the determination in step ST3, when the pump-down prohibition condition is satisfied, the processing proceeds to step ST5 in which the outdoor controller (101) performs the pump-down prohibition action. Specifically, the outdoor controller (101) sends a second instruction to the indoor controller (102) such that the indoor controller (102) opens the indoor expansion valve (53) or maintains the indoor expansion valve (53) at the open state. When the indoor controller (102) receives the second instruction, then the indoor controller (102) opens the indoor expansion valve (53) or maintains the indoor expansion valve (53) at the open state. At this time, the outdoor controller (101) stops the compression unit (20). With this configuration, the refrigerant does not flow into the outdoor heat exchanger (13) and the gas-liquid separator (15). The pump-down prohibition condition indicates that the internal pressure of the gas-liquid separator (15) is equal to or more than the critical pressure of the refrigerant. By the pump-down prohibition action, the refrigerant does not flow into the outdoor heat exchanger (13) and the gas-liquid separator (15). This configuration therefore suppresses a further pressure rise at the outdoor heat exchanger (13) and the gas-liquid separator (15).

Next, a brief description will be given of the actions in the thermo-on state. At startup of the compression unit (20) after the pump-down prohibition action, the outdoor controller (101) performs the liquid compression avoidance action (the first action) of stopping the second and third compressors (22, 23) constituting the lower-stage compression element and operating the first compressor (21) constituting the higher-stage compression element. At this time, the refrigerant in the indoor unit (50) flows into the outdoor unit. In the outdoor unit, since only the first compressor (21) operates, the refrigerant flows into the intermediate heat exchanger (17) via the third bypass passage (23*c*). Since the cooling fan (17*a*) rotates, the intermediate heat exchanger (17) evaporates the refrigerant by causing the refrigerant to exchange heat with outdoor air. At this time, the intermediate heat exchanger (17) does not function as a cooler for cooling the refrigerant, but functions as an evaporator for heating and evaporating the refrigerant. The refrigerant, which has been evaporated by the intermediate heat exchanger (17), is sucked into and compressed by the first compressor (21). The refrigerant then flows into each of the outdoor heat exchanger (13) and the gas-liquid separator (15). The refrigerant in the gas-liquid separator (15) then flows toward the indoor unit (50).

When the suction pressure of the compression unit (20) has a value equal to or less than the predetermined value at startup of the compression unit (20) or when the suction pressure (or the intermediate pressure) of the compression unit (20) has a value equal to or less than the predetermined value in the liquid compression avoidance action, the outdoor controller (101) performs the normal startup action (the second action) of operating the lower-stage compression element (i.e., at least one of the second compressor (22) or the third compressor (23)) and the higher-stage compression element (21) and causing the intermediate heat exchanger (17) to function as a cooler. In the normal startup action, the refrigerant is subjected to two-stage compression at the lower-stage compression element (22, 23) and the higher-stage compression element (21).

Figure 11:
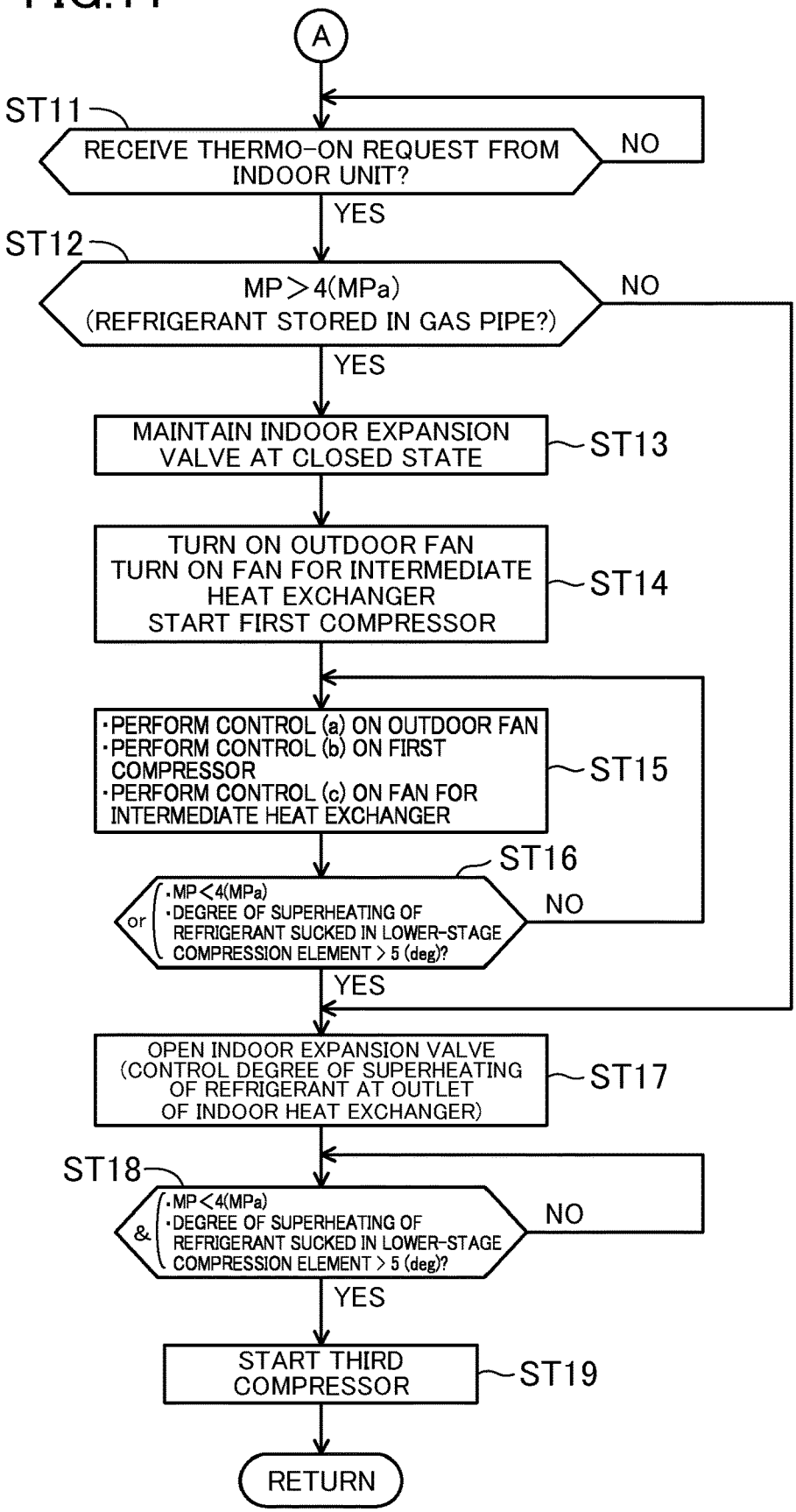
FIG. 11 is a flowchart of control in a thermo-on state.

With reference to the flowchart of FIG. 11, a detailed description will be given of the thermo-on control. FIG. 12A, FIG. 12B, and FIG. 12C illustrate the details of control in step ST15 illustrated in FIG. 11.

In step ST11, the outdoor controller (101) determines whether to receive a thermo-on request from the indoor controller (102). The processing does not proceed to step ST12 until the outdoor controller (101) receives a thermo-on request. When the outdoor controller (101) determines in step ST11 that the outdoor controller (101) receives the thermo-on request, the processing proceeds to step ST12. In step ST12, the outdoor controller (101) determines whether the intermediate pressure (MP) as the suction pressure of the first compressor (21) is higher than 4 MPa. When the intermediate pressure (MP) is higher than 4 MPa, the outdoor controller (101) determines that the intermediate pressure (MP) increases since the liquid refrigerant is stored in the first gas connection pipe (3).

When the outdoor controller (101) determines in step ST12 that the intermediate pressure (MP) is higher than 4 MPa, the processing proceeds to step ST13 in which the outdoor controller (101) sends an instruction to the indoor controller such that the indoor controller maintains the indoor expansion valve (53) at the closed state. Step ST13 corresponds to a starting point of the liquid compression avoidance action. In step ST14, next, the outdoor controller (101) turns on the outdoor fan (12), turns on the fan (the cooling fan) (17*a*) for the intermediate heat exchanger (17), and starts the first compressor (21) constituting the higher-stage compression element. However, the outdoor controller (101) does not start the second and third compressors (22, 23).

In step ST15, next, the outdoor controller (101) performs control (also referred to as control (a)) on the outdoor fan (12), performs control (also referred to as control (b)) on the first compressor (21), and performs control (also referred to as control (c)) on the fan (the cooling fan) (17*a*) for the intermediate heat exchanger (17).

The outdoor controller (101) performs control (a) illustrated in FIG. 12A for increasing or reducing a rotational speed of the outdoor fan (12) in accordance with a condition. Specifically, the outdoor controller (101) makes a determination as to whether to reduce the rotational speed of the outdoor fan (12) on the basis of a relationship between the high pressure (HP) and the critical pressure (about 7.2 MPa) of the refrigerant and the temperatures of the respective components. When a DOWN condition (see FIG. 12A) is satisfied, the outdoor controller (101) reduces the rotational speed of the outdoor fan (12). The outdoor controller (101) makes a determination as to whether to increase the rotational speed of the outdoor fan (12) on the basis of the relationship between the high pressure (HP) and the critical pressure (about 7.2 MPa) of the refrigerant and the temperatures of the respective components. When an UP condition (see FIG. 12A) is satisfied, the outdoor controller (101) increases the rotational speed of the outdoor fan (12). The outdoor controller (101) thus appropriately controls the rotational speed of the outdoor fan (12).

The outdoor controller (101) performs control (b) illustrated in FIG. 12B for controlling an operating capacity, in other words, a rotational speed of the first compressor (21) constituting the higher-stage compression element, in accordance with a relationship between the intermediate pressure (MP) and a target evaporation pressure. Specifically, when the intermediate pressure (MP) is lower than the target evaporation pressure, the outdoor controller (101) determines that the DOWN condition is satisfied, and decreases the operating capacity. When the intermediate pressure (MP) is higher than the target evaporation pressure, the outdoor controller (101) determines that the UP condition is satisfied, and increases the operating capacity. The outdoor controller (101) thus appropriately controls the operating capacity of the first compressor (21).

The outdoor controller (101) performs control (c) illustrated in FIG. 12C for increasing or reducing a rotational speed of the cooling fan (17*a*) for the intermediate heat exchanger (17) in accordance with a condition. Specifically, when the outside temperature is lower than the temperature (Ts3) of the refrigerant sucked in the third compressor (23), the outdoor controller (101) determines that the DOWN condition is satisfied, and reduces the rotational speed of the cooling fan (17*a*). When the degree of suction superheating (SH1) of the first compressor (21) is lower than 5 (deg), the outdoor controller (101) determines that the UP condition is satisfied, and increases the rotational speed of the cooling fan (17*a*).

In step ST15, the outdoor controller (101) controls the rotational speed of the outdoor fan (12), the operating capacity of the first compressor (21), and the rotational speed of the cooling fan (17*a*). The processing then proceeds to step ST16. In step ST16, the outdoor controller (101) determines which one of a condition that the intermediate pressure (MP) is lower than 4 MPa and a condition that the degree of superheating, which is previously obtained before step ST16, of the refrigerant sucked in the third compressor (23) is higher than 5 (deg) is satisfied. When a result of the determination in step ST16 is "YES", the processing proceeds to step ST17. When a result of the determination is "NO", the processing returns to step ST15. The outdoor controller (101) then carries out the processing tasks in steps ST15 and ST16 again.

As long as the result of the determination in step ST16 is "NO", the outdoor controller (101) starts only the first compressor (21). In the refrigerant circuit (6), the refrigerant downstream of the indoor expansion valve (53) thus flows into the outdoor unit (10), passes through the third bypass passage (23*c*), and flows into the intermediate heat exchanger (17). In the intermediate heat exchanger (17), the refrigerant evaporates by heat exchange with the outdoor air. After the intermediate heat exchanger (17) evaporates the refrigerant, the first compressor (21) sucks in the refrigerant and compresses the refrigerant. As described above, the processing tasks up to step ST16 correspond to the liquid compression avoidance action.

When the result of the determination in step ST16 is "YES", the processing proceeds to step ST17 in which the outdoor controller (101) opens the indoor expansion valve (53). In step ST18, next, the outdoor controller (101) determines whether the intermediate pressure (MP) is lower than 4 MPa and the degree of superheating of the refrigerant sucked in the third compressor (23) is higher than 5 (deg). When a result of the determination is "NO", the outdoor controller (101) makes a determination in step ST18 again. When a result of the determination is "YES", the processing proceeds to step ST19. In step ST19, the outdoor controller (101) starts the third compressor (23). At this time, the outdoor controller (101) makes a transition from the liquid compression avoidance action to the normal startup action.

Through the actions based on the flowcharts described above, at startup of the compression unit (20) after the pump-down prohibition action in the thermo-off state, in the outdoor unit (10), the intermediate heat exchanger (17) evaporates the refrigerant, and the first compressor (21) then sucks in the refrigerant. This configuration therefore suppresses occurrence of liquid compression. In addition, when the sucked refrigerant is heated at a predetermined degree of superheating, then the refrigerant is subjected to the two-stage compression action at normal startup.

—Advantageous Effects of Embodiment—

According to this embodiment, a refrigeration apparatus (1) includes an outdoor controller (101) configured to control an action of a refrigeration circuit (6) through which carbon dioxide circulates as a refrigerant. The refrigeration apparatus (1) also includes a compression unit (20) including second and third compressors (22, 23) constituting a lower-stage compression element and each configured to compress the refrigerant, and a first compressor (21) constituting a higher-stage compression element and configured to further compress the refrigerant compressed by each of the second and third compressors (22, 23). The refrigeration apparatus (1) also includes an intermediate heat exchanger (17) disposed on a refrigerant path between the second and third compressors (22, 23) and the first compressor (21) and configured to cause the refrigerant to exchange heat with a heating medium. The refrigeration apparatus (1) also includes a bypass passage (22*c*) connected to a suction pipe (22*a*) and a discharge pipe (22*b*) each connected to the second compressor (22), for bypassing the second compressor (22), and a bypass passage (23*c*) connected to a suction pipe (23*a*) and a discharge pipe (23*b*) each connected to the third compressor (23), for bypassing the third compressor (23).

The outdoor controller (101) performs a liquid compression avoidance action (a first action) of stopping the second and third compressors (22, 23), operating the first compressor (21), and causing the intermediate heat exchanger (17) to function as an evaporator at startup of the compression unit (20).

According to a known refrigeration apparatus, a compressor that is started with a refrigerant stored in a utilization-side unit sucks in the liquid refrigerant, which may result in liquid compression. The liquid compression may cause damage to the compressor.

According to this embodiment, hence, a consideration is given to startup of the outdoor unit (10) in a state in which the liquid refrigerant flows through a path between an indoor unit (50) and the suction pipe (23*a*) connected to the third compressor (23). When the liquid compression avoidance action is performed at this time, the liquid refrigerant in the indoor unit (50) flows into the outdoor unit (10). Since the third compressor (23) stops, the liquid refrigerant flows through the third bypass passage (23*c*) and the intermediate heat exchanger (17) and then is sucked into the first compressor (21).

During the liquid compression avoidance action, the intermediate heat exchanger (17) functions as an evaporator. Specifically, the intermediate heat exchanger (17) is an air heat exchanger configured to cause the refrigerant to exchange heat with air. When a cooling fan (17*a*) provides air to the intermediate heat exchanger (17), the intermediate heat exchanger (17) evaporates the refrigerant. Therefore, the refrigerant evaporated by the intermediate heat exchanger (17) flows into the first compressor (21). This configuration thus suppresses occurrence of liquid compression at startup of the compression unit (20).

According to this embodiment, the outdoor controller (101) performs the liquid compression avoidance action on condition that a suction pressure of the compression unit (20) has a value more than a predetermined value. This is because when the amount of the liquid refrigerant stored in a suction gas path from the indoor unit (50) to the compression unit (20) is equal to or more than a predetermined amount, a pressure at the suction gas path increases. According to this embodiment, the outdoor controller (101) performs the liquid compression avoidance action on condition that the suction pressure of the compression unit (20) has a value more than the predetermined value. The liquid refrigerant is thus evaporated by the intermediate heat exchanger (17) and then is sucked into the first compressor (21). This configuration therefore suppresses occurrence of liquid compression.

According to this embodiment, on condition that the suction pressure of the compression unit (20) has a value equal to or less than the predetermined value at startup of the compression unit (20), the outdoor controller (101) performs a normal startup action of operating both the second and third compressors (22, 23) and the first compressor (21) and causing the intermediate heat exchanger (17) to function as a cooler. This is because the outdoor controller (101) determines that the refrigerant sucked in the compression unit (20) is heated at a predetermined degree of superheating on condition that the suction pressure of the compression unit (20) has a value equal to or less than the predetermined value. According to this embodiment, as described above, on condition that the suction pressure of the compression unit (20) has a value equal to or less than the predetermined value, the outdoor controller (101) determines that no liquid compression occurs, and operates at least one of the second and third compressors (22, 23) and the first compressor (21) without performing the liquid compression avoidance action. The outdoor controller (101) then performs the normal startup action (a two-stage compression operation) of causing the intermediate heat exchanger (17) to function as a cooler.

According to this embodiment, the outdoor controller (101) makes a transition to the normal startup action of operating at least one of the second and third compressors (22, 23) and the first compressor (21) and causing the intermediate heat exchanger (17) to function as a cooler also on condition that the suction pressure of the compression unit (20) has a value equal to or less than the predetermined value in the first action. This is because the outdoor controller (101) determines that no liquid compression occurs when the suction pressure of the compression unit (20) has a value equal to or less than the predetermined value in the liquid compression avoidance action.

According to this embodiment, the indoor unit (50) includes an indoor expansion valve (53) to be closed during the liquid compression avoidance action.

With this configuration, during the liquid compression avoidance action, in the refrigerant circuit (6), the refrigerant downstream of the indoor expansion valve (53) flows into the outdoor unit (10). In the outdoor unit (10), the refrigerant is evaporated by the intermediate heat exchanger (17) and then is sucked into the first compressor (21). This configuration thus suppresses liquid compression.

According to this embodiment, the outdoor controller (101) performs the liquid compression avoidance action at startup of the compression unit (20) after a high pressure at the refrigerant circuit (6) exceeds a critical pressure in the course of or after a stop of the compression unit (20) and then the indoor expansion valve (53) is opened. This is because it can be considered that the liquid refrigerant is stored in the outdoor unit (10) when the high pressure at the refrigerant circuit (6) exceeds the critical pressure in the course of or after the stop of the compression unit (20). In this case, there is a possibility that the liquid refrigerant flows into the utilization-side unit when the indoor expansion valve (53) is opened after the stop of the compression unit (20). According to this embodiment, hence, the outdoor controller (101) starts the compression unit (20) after the high pressure at the refrigerant circuit (6) exceeds the critical pressure in the course of or after the stop of the compression unit (20) and then the indoor expansion valve (53) is opened. This configuration thus suppresses occurrence of liquid compression.

According to this embodiment, particularly, the outdoor controller (101) performs a third operation of stopping the third compressor (23) constituting the lower-stage compression element, operating the first compressor (21) constituting the higher-stage compression element, and causing the intermediate heat exchanger (17) to function as an evaporator at startup of the compression unit (20) after the outdoor controller (101) performs a pump-down prohibition action to prohibit a pump-down action.

In a state in which the outdoor controller (101) prohibits the pump-down action and the indoor unit (50) stops, the refrigerant (the liquid refrigerant) is sometimes stored downstream of the indoor expansion valve (53). According to this embodiment, in starting the compression unit (20) in this state, the outdoor controller (101) performs the liquid compression avoidance action of stopping the third compressor (23) constituting the lower-stage compression element and operating the first compressor (21) constituting the higher-stage compression element. The liquid refrigerant to be returned to the outdoor unit thus flows through the bypass passage (23*c*) so as to detour around the third compressor (23). The liquid refrigerant is then evaporated by the intermediate heat exchanger (17) and is sucked into the first compressor (21). This configuration thus suppresses occurrence of liquid compression in the compression unit (20).

«Other Embodiments»

The foregoing embodiment may have the following configurations.

The refrigeration apparatus (1) may include one heat source-side unit and one utilization-side unit. The utilization-side unit may be an indoor unit (50) for conditioning indoor air or may be a cooling facility unit (60) for cooling inside air.

The refrigeration apparatus (1) may include one outdoor unit (10) and a plurality of indoor units (50) connected in parallel to the outdoor unit (10). The refrigeration apparatus (1) may alternatively include one outdoor unit (10) and a plurality of cooling facility units (60) connected in parallel to the outdoor unit (10). In other words, the refrigeration apparatus (1) may include a common suction pipe through which a refrigerant in each of the utilization-side units flows into a compression unit of the heat source-side unit.

In the foregoing embodiment, the outdoor controller (101) performs the liquid compression avoidance action at startup of the compression unit (20) after the pump-down prohibition action which the outdoor controller (101) performs in the thermo-off state (i.e., the stop operation) of the indoor unit (50). However, the liquid compression avoidance action is not necessarily performed after the pump-down prohibition action. For example, the outdoor controller (101) may perform the liquid compression avoidance action when determining that the liquid refrigerant is stored in the refrigerant path from the utilization-side unit (50, 60) to the compression unit (20).

In the foregoing embodiment, the intermediate heat exchanger (17) is an air heat exchanger. However, the intermediate heat exchanger (17) is not limited to an air heat exchanger. For example, the intermediate heat exchanger (17) may be another heat exchanger such as a plate heat exchanger configured to cause a refrigerant to exchange heat with a heating medium such as water.

In the foregoing embodiment, the refrigerant in the refrigerant circuit is not limited to carbon dioxide. In addition, the refrigerant circuit is not limited to a circuit in which a high pressure of a refrigerant reaches or exceeds a critical pressure.

In the foregoing embodiment, the outdoor controller (101) makes a determination on the pump-down prohibition condition and performs the pump-down action and the pump-down prohibition action. Alternatively, another controller may make a determination on the pump-down prohibition condition and perform the pump-down action and the pump-down prohibition action. For example, in a system including the refrigeration apparatus (1) and a central remote controller connected to the refrigeration apparatus (1) for controlling the operations to be carried out by the refrigeration apparatus (1), a central controller of the central remote controller may perform the control described above. In this case, the central controller may control the liquid compression avoidance action.

While the embodiments and modifications have been described herein above, it is to be appreciated that various changes in form and detail may be made without departing from the spirit and scope presently or hereafter claimed. In addition, the foregoing embodiments and modifications may be appropriately combined or substituted as long as the combination or substitution does not impair the functions of the present disclosure. The foregoing ordinal numbers such as "first", "second", and "third" are merely used for distinguishing the elements designated with the ordinal numbers, and are not intended to limit the number and order of the elements.

INDUSTRIAL APPLICABILITY

As described above, the present disclosure is useful for a refrigeration apparatus.

REFERENCE SIGNS LIST

1: refrigeration apparatus
6: refrigerant circuit
10: outdoor unit (heat source-side unit)
13: outdoor heat exchanger (radiator)
15: gas-liquid separator (refrigerant storage reservoir)
14: outdoor expansion valve (heat source-side expansion mechanism)
17: intermediate heat exchanger
20: compression unit
21: first compressor (higher-stage compression element)
23: third compressor (lower-stage compression element)
23*a*: third suction pipe
23*b*: third discharge pipe
23*c*: third bypass passage
50: indoor unit (utilization-side unit)
53: indoor expansion valve (utilization-side expansion mechanism)
100: controller (control unit)

The invention claimed is:

1. A heat source-side unit to be connected to a utilization-side device to constitute a refrigerant circuit in conjunction with the utilization-side device, the heat source-side unit comprising:

a heat source-side circuit constituting at least a part of the refrigerant circuit; and a control unit configured to control an operation of the heat source-side circuit, wherein the heat source-side circuit includes:

a compression unit including a lower-stage compressor configured to compress a refrigerant, and a higher-stage compressor configured to further compress the refrigerant compressed by the lower-stage compressor;

an intermediate heat exchanger disposed on a refrigerant path between the lower-stage compressor and the higher-stage compressor and configured to cause the refrigerant to exchange heat with a heating medium; and a bypass passage connected to a suction pipe and a discharge pipe each connected to the lower-stage compressor, for bypassing the lower-stage compressor, and in a startup of the compression unit after the compression unit is stopped, the control unit performs a first action of maintaining the lower-stage compressor in a stopped state and operating the higher-stage compressor, and the control unit performs the first action on condition that a suction pressure of the compression unit has a value more than a predetermined value.

2. The heat source-side unit according to claim 1, wherein the intermediate heat exchanger is an air heat exchanger configured to cause the refrigerant to exchange heat with air, the heat source-side unit further comprising a fan configured to provide air to the intermediate heat exchanger, wherein the control unit performs the first action while operating the fan.

3. The heat source-side unit according to claim 1, wherein the control unit performs a second action of operating both the lower-stage compressor and the higher-stage compressor and causing the intermediate heat exchanger to function as a cooler on condition that a suction pressure of the compression unit has a value equal to or less than a predetermined value at the startup of the compression unit.

4. The heat source-side unit according to claim 1, wherein on condition that a suction pressure of the compression unit has a value equal to or less than a predetermined value in the first action, the control unit makes a transition to a second action of operating both the lower-stage compressor and the higher-stage compressor and causing the intermediate heat exchanger to function as a cooler.

5. The heat source-side unit according to claim 1, wherein the refrigerant in the refrigerant circuit comprises carbon dioxide.

6. A refrigeration apparatus comprising a refrigerant circuit including a heat source-side unit and a utilization-side unit as a utilization-side device connected to the heat source-side unit, the refrigerant circuit being configured to perform a refrigeration cycle, wherein the heat source-side unit is the heat source-side unit according to claim 1.

7. The refrigeration apparatus according to claim 6, wherein the utilization-side unit includes a utilization-side expansion valve to be closed during the first action.

8. The refrigeration apparatus according to claim 7, wherein the control unit performs the first action at the startup of the compression unit after a high pressure at the refrigerant circuit exceeds a predetermined first pressure in a course of or after a stop of the compression unit and then the utilization-side expansion valve is opened.

* * * * *